US009352891B2

(12) United States Patent
LeRoy et al.

(10) Patent No.: US 9,352,891 B2
(45) Date of Patent: May 31, 2016

(54) SUSPENSION PACKAGING STRUCTURES AND METHODS OF MAKING AND USING THE SAME

(71) Applicant: ADE, INC., Chicago, IL (US)

(72) Inventors: Matthew D. LeRoy, Bourbonnais, IL (US); Jason C. Lofgren, Chicago, IL (US); James E. Gasaway, Lakestation, IN (US); Michael T. McGrath, Channahon, IL (US)

(73) Assignee: ADE, Inc., Chicago, IL (US)

( * ) Notice: Subject to any disclaimer, the term of this patent is extended or adjusted under 35 U.S.C. 154(b) by 0 days.

(21) Appl. No.: 14/136,037

(22) Filed: Dec. 20, 2013

(65) Prior Publication Data

US 2014/0183097 A1 Jul. 3, 2014

Related U.S. Application Data

(60) Provisional application No. 61/803,521, filed on Mar. 20, 2013, provisional application No. 61/774,267, filed on Mar. 7, 2013, provisional application No. 61/746,805, filed on Dec. 28, 2012.

(51) Int. Cl.

| | |
|---|---|
| ***B65D 81/00*** | (2006.01) |
| ***B65D 75/30*** | (2006.01) |
| ***B65D 81/05*** | (2006.01) |
| ***B65D 81/07*** | (2006.01) |

(52) U.S. Cl.

CPC ..... *B65D 75/305* (2013.01); *B65D 81/05* (2013.01); *B65D 81/07* (2013.01); *Y10T 29/49826* (2015.01)

(58) Field of Classification Search

CPC ..... B65D 75/305; B65D 81/02; B65D 81/05; B65D 81/07; B65D 81/075; Y10T 29/49826

USPC ..... 206/583, 591, 594

See application file for complete search history.

(56) References Cited

U.S. PATENT DOCUMENTS

| | | | |
|---|---|---|---|
| 1,933,516 | A | 10/1933 | Rosen |
| 2,553,418 | A | 5/1951 | Loth |
| 2,697,546 | A | 12/1954 | Bergstein |
| 2,837,208 | A | 6/1958 | Lingenfelter |
| 3,089,590 | A | 5/1963 | Mell |
| 3,554,368 | A | 1/1971 | Nagel |
| 3,905,474 | A | 9/1975 | Haibara |
| 4,285,432 | A | 8/1981 | de Villers et al. |

(Continued)

FOREIGN PATENT DOCUMENTS

| | | | |
|---|---|---|---|
| DE | 1465150 | U | 5/1939 |
| DE | 3340155 | A1 | 4/1984 |

(Continued)

*Primary Examiner* — Bryon Gehman

(74) *Attorney, Agent, or Firm* — Cook Alex Ltd.

(57) ABSTRACT

A packaging structure that is adapted for insertion into an outer container. The packaging structure includes a support frame including at least a platform panel having opposed first and second faces and at least a pair of opposed side panels pivotally connected to the platform panel. A first flexible sheet overlies at least a portion of the first face of the platform panel and a second flexible sheet overlies at least a portion of the first flexible sheet and is coupled to the pair of opposed side panels to allow the second flexible sheet to be tensioned when the side panels are pivoted away from the first face of the platform panel.

22 Claims, 13 Drawing Sheets

(56) References Cited

U.S. PATENT DOCUMENTS

| | | | | |
|---|---|---|---|---|
| 4,307,804 | A | 12/1981 | Benham | |
| 4,606,460 | A | 8/1986 | Luray | |
| 4,852,743 | A | 8/1989 | Ridgeway | |
| 5,056,665 | A | 10/1991 | Boecker et al. | |
| 5,071,009 | A | 12/1991 | Ridgeway | |
| 5,115,618 | A | 5/1992 | Janhonen | |
| 5,183,159 | A | 2/1993 | Hojnacki et al. | |
| 5,226,542 | A | 7/1993 | Boecker et al. | |
| 5,287,968 | A | 2/1994 | Ridgeway | |
| 5,323,896 | A | 6/1994 | Jones | |
| 5,388,701 | A | 2/1995 | Ridgeway | |
| 5,676,245 | A | 10/1997 | Jones | |
| 5,678,695 | A | 10/1997 | Ridgeway et al. | |
| 5,694,744 | A | 12/1997 | Jones | |
| 5,803,261 | A | 9/1998 | Nowakowski et al. | |
| 5,893,462 | A | 4/1999 | Ridgeway | |
| 5,894,932 | A * | 4/1999 | Harding et al. | 206/583 |
| 5,967,327 | A | 10/1999 | Jones | |
| RE36,412 | E | 11/1999 | Jones | |
| 5,975,307 | A | 11/1999 | Harding et al. | |
| 6,010,006 | A | 1/2000 | Ridgeway et al. | |
| 6,047,831 | A | 4/2000 | Jones | |
| 6,073,761 | A | 6/2000 | Jones | |
| 6,148,590 | A | 11/2000 | Ridgeway et al. | |
| 6,148,591 | A | 11/2000 | Ridgeway et al. | |
| 6,158,589 | A | 12/2000 | Smith et al. | |
| 6,289,655 | B1 | 9/2001 | Ridgeway et al. | |
| 6,302,274 | B1 | 10/2001 | Ridgeway | |
| 6,308,828 | B1 | 10/2001 | Jones | |
| 6,311,843 | B1 | 11/2001 | Smith et al. | |
| 6,311,844 | B1 | 11/2001 | Ridgeway et al. | |
| RE37,910 | E | 11/2002 | Nowakowski | |
| 6,675,973 | B1 | 1/2004 | McDonald et al. | |
| 6,899,229 | B2 | 5/2005 | Dennison | |
| 6,913,147 | B2 | 7/2005 | Mueller et al. | |
| 6,920,981 | B2 | 7/2005 | Lofgren et al. | |
| 6,923,324 | B2 | 8/2005 | Kanai | |
| 7,082,274 | B2 | 7/2006 | Saitoh et al. | |
| 7,086,534 | B2 | 8/2006 | Roesel | |
| 8,123,039 | B2 | 2/2012 | McDonald et al. | |
| 8,177,067 | B2 | 5/2012 | McDonald et al. | |
| 8,181,787 | B2 | 5/2012 | Klos | |
| 8,235,216 | B2 | 8/2012 | McDonald et al. | |
| 8,714,357 | B2 * | 5/2014 | Ridgeway | 206/583 |
| 8,727,123 | B1 * | 5/2014 | Roberts | B65D 81/075 206/583 |
| 9,150,343 | B2 * | 10/2015 | Roberts | B65D 81/075 |
| 2001/0047950 | A1 | 12/2001 | Beneroff et al. | |
| 2004/0140243 | A1 | 7/2004 | Roesel | |
| 2004/0178113 | A1 | 9/2004 | Lofgren et al. | |
| 2011/0240515 | A1 | 10/2011 | Ridgeway | |
| 2013/0233752 | A1 | 9/2013 | Hammerschmidt | |

FOREIGN PATENT DOCUMENTS

| | | |
|---|---|---|
| GB | 475299 A | 11/1937 |
| GB | 1224493 | 3/1971 |
| JP | 48-143793 | 12/1948 |
| JP | 49-59982 | 5/1974 |
| JP | 49-77087 | 7/1974 |
| JP | 50-88376 | 7/1975 |
| JP | 50-102778 | 8/1975 |
| JP | 50-107583 | 9/1975 |
| JP | 53-135796 | 11/1978 |
| JP | 57-177969 | 11/1982 |
| JP | 3-100158 | 10/1991 |
| SU | 685567 | 9/1979 |
| SU | 827346 | 5/1981 |

* cited by examiner

SUSPENSION PACKAGING STRUCTURES AND METHODS OF MAKING AND USING THE SAME

CROSS-REFERENCE TO RELATED APPLICATION

This application claims the benefit of U.S. Provisional Patent Application Ser. No. 61/746,805, filed Dec. 28, 2012, U.S. Provisional Patent Application Ser. No. 61/774,267, filed Mar. 7, 2013, and U.S. Provisional Patent Application Ser. No. 61/803,521, filed Mar. 20, 2013, all of which are hereby incorporated by reference in their entirety.

FIELD OF DISCLOSURE

This disclosure relates generally to packaging, and more particularly to suspension packaging structures for supporting and protecting articles from damage during shipping, and to methods of making and using the same. The suspension packaging structures are adapted for insertion into an outer container.

BACKGROUND

When shipping an article or product that is sensitive to impact or movement within a container, various packaging structures may be used to avoid damage to the article by providing spacing between walls of a container and the article, and by holding the article in a preselected position within the container. The use of such packaging structures is useful for transporting articles that may or may not necessarily be regarded as being fragile and for which immobilization during shipment is desirable, such as, for example, cell phones, laptop or notebook computers, handheld electrical devices, books, compact discs (CDs), digital video discs (DVDs), and a variety of other articles. These types of articles also may be subjected to damage in shipment, such as scuffing, dulling or the like, which is caused by movement against and within a container. This form of damage may be caused by gross movement of the product and/or impact with the interior wall of the container, or even by movement wherein the product rubs against a support structure within the container.

Some of the packaging structures are constructed as retention packaging configured to retain an article against a substantially rigid panel that is constructed of corrugated fiberboard or other forms of cardboard, or plastic, by using flexible sheet material, which is held in tension. Other forms of such packaging structures are constructed as suspension packaging that is configured to suspend an article between sheets of flexible material that are held in a position spaced from walls of the container. While such packaging structures may be useful, they may be complex, relatively expensive to assemble, and require substantial amounts of flexible sheet material and corrugated fiberboard or cardboard, or the like. Accordingly, there is a continuing need for improved and low cost packaging structures that provide sufficient protection for an article, while providing ease of use and reduced cost.

SUMMARY

The scope of the present disclosure is defined solely by the appended claims, and nothing in this summary is intended to limit the claims. Moreover, there are several aspects of the present subject matter that may be embodied separately or together in various packages or packaging structures. These aspects may be employed alone or in combination with other aspects of the subject matter described herein and the description of these aspects together is not intended to preclude use of these aspects separately or the claiming of such aspects separately or in different combinations, as set forth in the claims appended hereto.

The present disclosure addresses one or more disadvantages of the prior art and provides efficient and recyclable packaging arrangements that are capable of holding articles against a flexible support panel and spaced from walls of a container. Indeed, the devices provide efficiencies with respect to ease of manufacturing, material use, cost, weight, bulk and in some examples, the lack of use of separate fasteners, while still providing numerous highly advantageous configurations to meet the needs associated with shipment of particular articles. It will be appreciated that "side", "end", "top" and "bottom" may be used herein for purposes of identification only and are not intended to suggest any particular dimensional quality or orientation, or to necessarily suggest any association with any particular direction. It further will be appreciated that the disclosure provides several examples having a platform panel that includes at least one opening and/or weakened zone lacking substantial rigidity and over which an article would be placed, which results in the platform panel as a whole lacking substantial rigidity. The at least one opening and/or weakened zone may be formed in many ways, which may range from relatively narrow slits or slits that form broader openings, as well as other broader openings of various shapes and sizes.

In one aspect, a packaging structure is provided that is adapted for insertion into an outer container. The packaging structure includes a support frame having at least a platform panel having first and second opposed faces and at least one opening and/or weakened zone lacking substantial rigidity therein, and at least a pair of opposed side panels pivotally connected to the platform panel. A first flexible sheet overlies at least a portion of the first face of the platform panel and extends over and beyond the at least one opening and/or weakened zone therein, with the first flexible sheet being connected to the support frame between respective edges of the first flexible sheet and edges of the at least one opening and/or weakened zone, wherein a flexible support panel is provided overlying the at least one opening and/or weakened zone. A second flexible sheet overlies at least a portion of the first flexible sheet and is coupled to the pair of opposed side panels to allow the second flexible sheet to be tensioned when the side panels are pivoted away from the first face of the platform panel.

In accordance with another aspect, a method of making a packaging structure adapted for insertion into an outer container is provided. The method includes the steps of providing a support frame having at least a platform panel having first and second opposed faces and at least one opening and/or weakened zone lacking substantial rigidity therein, and at least a pair of opposed side panels pivotally connected to the platform panel, providing a first flexible sheet overlying at least a portion of the first face of the platform panel and extending over and beyond the at least one opening and/or weakened zone therein, and connecting the first flexible sheet to the support frame between respective edges of the first flexible sheet and edges of the at least one opening and/or weakened zone, wherein a flexible support panel is formed overlying the at least one opening and/or weakened zone. Additional steps of the method include providing a second flexible sheet overlying at least a portion of the first flexible sheet, and coupling the second flexible sheet to the pair of opposed side panels to allow the second flexible sheet to be tensioned when the side panels are pivoted away from the first face of the platform panel.

The novel and nonobvious structures and methods of making and using suspension packages disclosed herein allow for unique suspension packaging solutions and present various configurations to provide desired features for end users. The suspension packages may be quickly, conveniently and efficiently manufactured, with the support frames and flexible sheets.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While some details of suspension packages and other plan and section views of the particular components have not been included, such details are considered to be within the comprehension of those of skill in the art in light of the present disclosure. It also should be understood that the present invention is not limited to the examples illustrated.

DESCRIPTION OF ILLUSTRATED EMBODIMENTS

Although the following discloses examples of suspension packages, persons of ordinary skill in the art will appreciate that the teachings of this disclosure are in no way limited to the specific examples shown. On the contrary, it is contemplated that the teachings of this disclosure may be implemented in alternative configurations, with alternative materials and in alternative environments.

In general, the example suspension packages and methods of making and using the same described herein facilitate convenient, cost effective and protective devices. FIGS. 1-7 show various advantageous examples of suspension packages.

Figure 1:
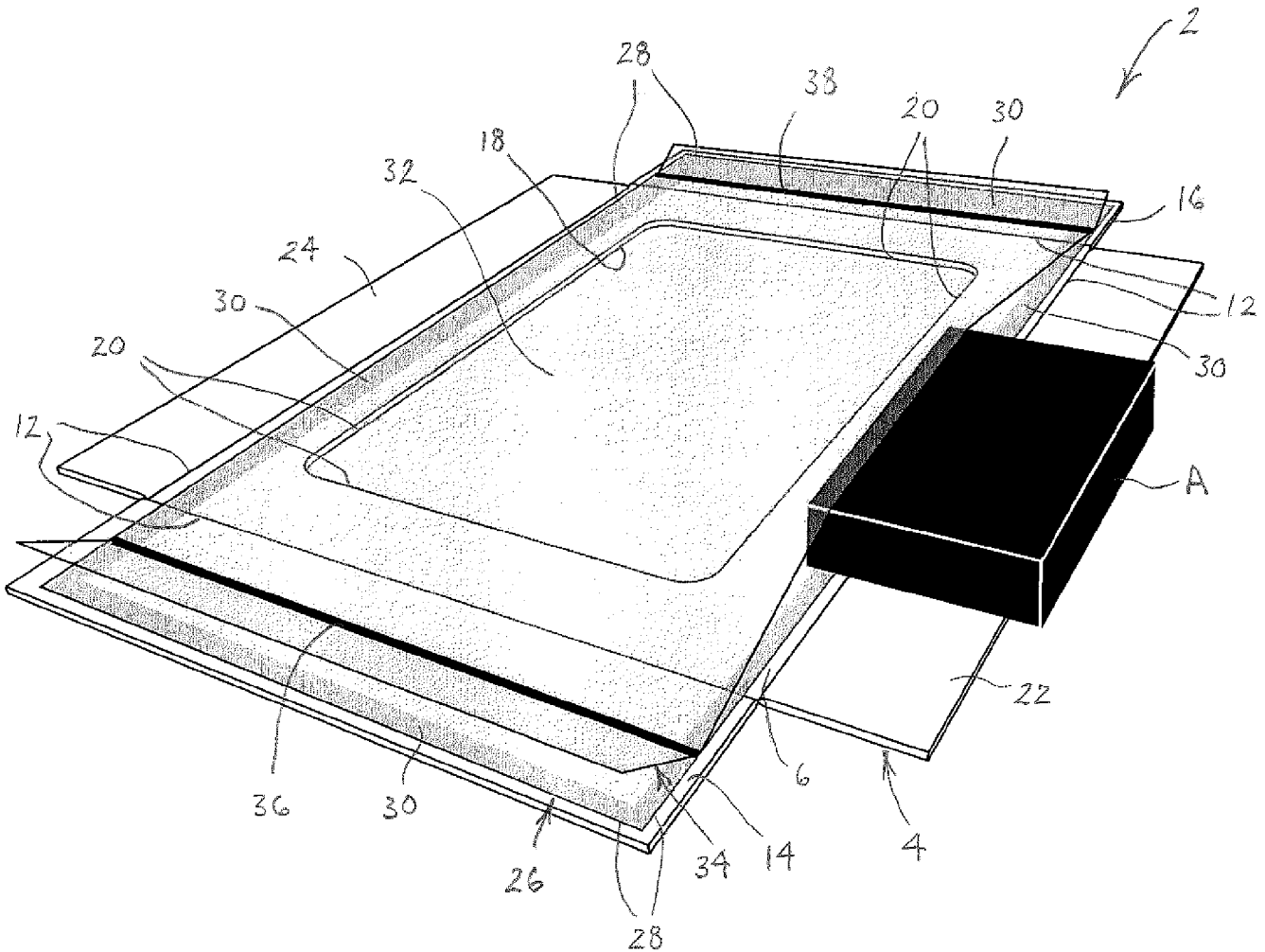
FIG. 1 is an upper perspective view of a first packaging structure adapted for insertion into an outer container and illustrating an article being inserted through an access opening between first and second flexible sheets wherein the second flexible sheet is coupled to pivotable side panels by being heat sealed to the first flexible sheet, wherein the first flexible sheet is connected to the pivotable opposed side panels and is connected to a platform panel along opposed edges between edges of an opening in the platform panel and outer edges of the platform panel.
Figure 2A:
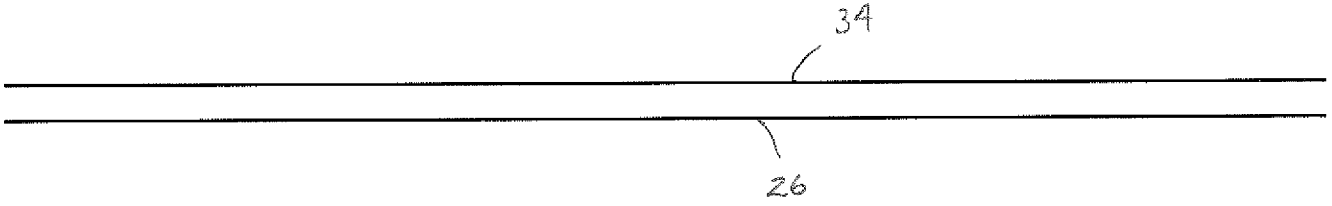
FIG. 2*a* is side view showing just the first and second flexible sheets of FIG. 1 aligned and in a spaced relationship with each other, for example during a manufacturing process.
Figure 2B:
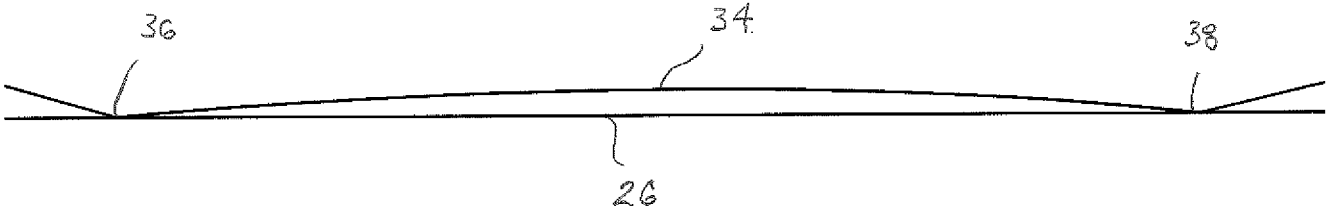
FIG. 2*b* is side view showing just the first and second flexible sheets of FIGS. 1 and 2*a* connected to each other proximate opposed edges.
Figure 3:
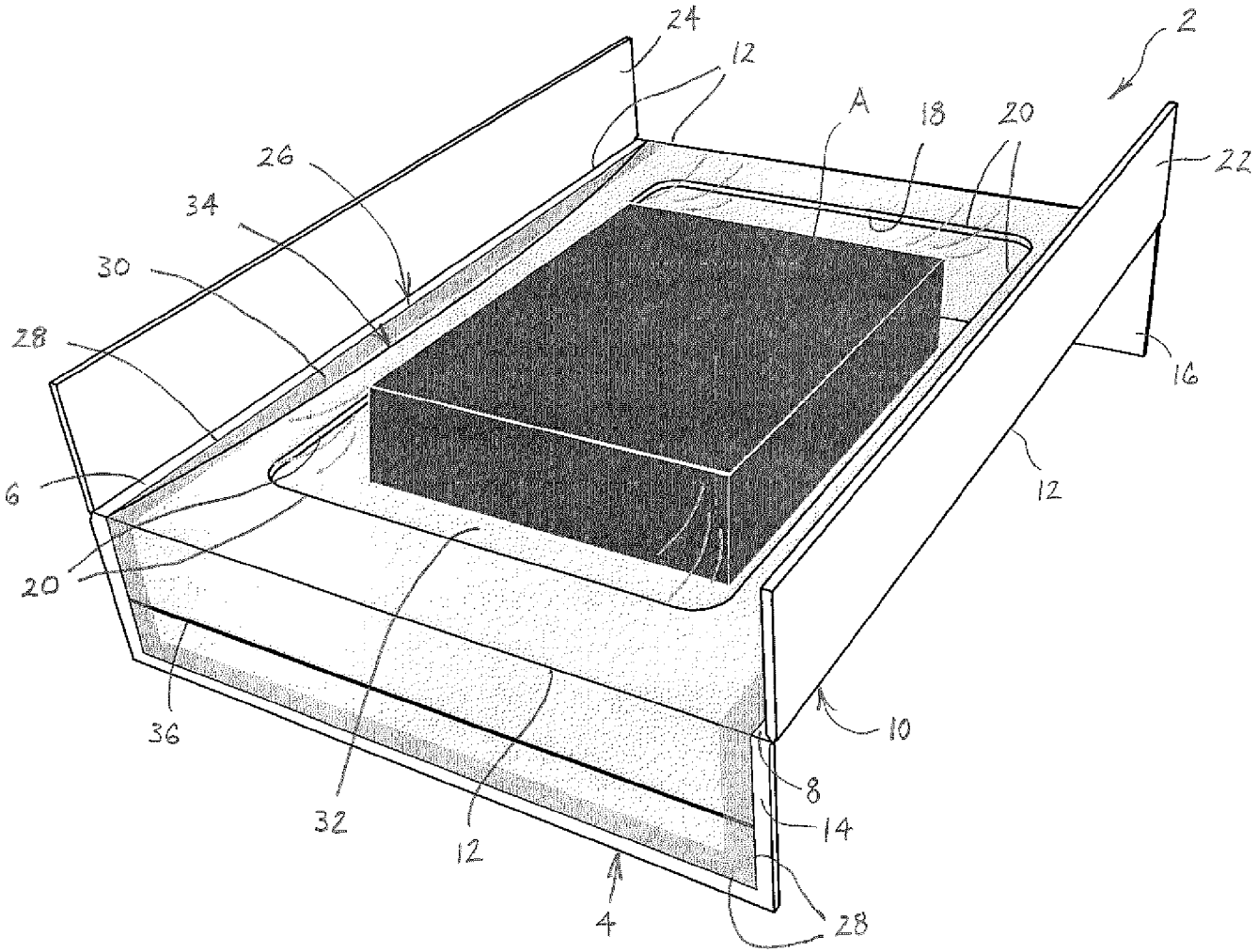
FIG. 3 is an upper perspective view of the packaging structure of FIG. 1 having an article located between the first and second flexible sheets and within an opening in a platform panel and with opposed side panels of a support frame pivoted away from a first face of the platform panel resulting in tensioning of the first and second flexible sheets.

Turning to FIGS. 1-3, a first example packaging structure is illustrated generally at 2 and includes a support frame 4 having at least a platform panel 6 having first and second opposed faces 8, 10, and outer edges 12. The platform panel 6 also is pivotally connected to a pair of opposed side panels 14, 16, such as along fold lines or other lines of weakness. Fold lines or lines of weakness in a support frame may be formed in many ways, such as, for example, by compressing a localized area, perforating or otherwise partially cutting through a portion of the support frame, or connecting two separate portions together, such as by use of tape, adhesive or other suitable structures. Indeed, the support frame 4 may be constructed of any suitable relatively rigid material, and may incorporate multiple materials for particular purposes, but preferably is constructed of corrugated fiberboard or other cardboard because of its light weight and ready ability to be recycled.

The platform panel 6 includes an opening or aperture 18 therethrough, which includes edges 20 and which generally is dimensioned to provide an opening that is larger than the article to be held within the packaging structure 2. The illustrated example platform panel 6 and opening 18 generally are rectangular in shape, but the actual shape used for the platform panel and opening may be varied as the particular packaging requirements demand, and multiple openings may be employed, for instance if a plurality of articles are to be shipped within a single outer container. The support frame 4 also may be pivotally connected to a second pair of opposed side panels 22, 24. The support frame 4 has an overall length in a first direction that includes the platform panel 6 and the pair of opposed side panels 14, 16 when the platform panel 6 and side panels 14, 16 are disposed in a planar orientation, such as is shown in FIG. 1.

A first flexible sheet 26 may be constructed of any suitable flexible material, such as a polymeric or plastic film, including but not limited to materials such as polyethylene, polyurethane, polyvinyl chloride or any other suitable materials, or fabric, mesh or other suitable materials, any of which preferably is resilient, stretchable and non-abrasive. The first flexible sheet 26 has outer edges 28 and an overall length in the first direction that is less than or equal to that of the support frame 4, including the platform panel 6 and the pair of side panels 14, 16 when disposed in a planar orientation. The first flexible sheet 26 also is less than or equal to the width of the platform panel 6 in a direction perpendicular to the first direction. This configuration allows the first flexible sheet 26 to be connected to the support frame 4 at locations between the outer edges 28 of the first flexible sheet 26 and the edges 20 of the opening 18 in the platform panel 6.

In this example, as may be seen in FIG. 1, the first flexible sheet 26 is connected to the pair of opposed pivotable side panels 14, 16 along two respective edges 28, and connected to the platform panel 6 and the pair of side panels 14, 16 along two other respective edges 28. As such, the connection of the first flexible sheet may be made to a single side of the support frame 4 in a very efficient and cost effective manner by use of adhesive, in the form of glue lines 30, glue strips or other suitable means of connection, which may be continuous or intermittent in pattern. The entire face of the support frame that underlies the first flexible sheet may also be covered with adhesive, if desired. As illustrated, glue lines 30 may be applied to the support frame 4 generally along and parallel to the edges 28 of the first flexible sheet 26. The flexible film is brought into contact with the support frame 4 and attached thereto along the glue lines 30. Also, it will be appreciated, and is noted with respect to another example packaging structure herein, that the first flexible sheet may be shorter in length than the platform panel but at least longer than the opening in the platform panel. This allows the first flexible sheet 26 to be connected to the support panel 4 at locations outside of the edges 20 of the opening in the platform panel 6, resulting in a flexible support panel 32 being formed over the opening 18 in the platform panel 6. Such an opening 18 also causes the platform panel 6 to lack substantial rigidity.

A second flexible sheet 34 is provided and has a length in the first direction that is generally less than or equal to the length of the support frame 4, including the platform panel 6 and the pair of side panels 14, 16 when disposed in a planar orientation. The second flexible sheet 34 is coupled to the pair of opposed pivotable side panels 14, 16. In this example, with a first flexible sheet 26 that extends over the side panels 14, 16, this may be accomplished in at least two ways. For instance, as shown in FIGS. 2*a* and 2*b*, the first and second flexible sheets 26, 34 can be brought into registration and then connected, such as by heat seals 36, 38, or by use of adhesive, glue strips or other suitable means of connection. Then, as shown in FIG. 3, the first flexible sheet 26 is connected to the side panels 14, 16 and the platform panel 6, such as by adhesive 30 or other means previously discussed. Alternatively, the first flexible sheet 26 could be connected to the support frame 4, followed by the second flexible sheet 34 being connected to the first flexible sheet 26, by any of the various suitable means of connection previously discussed. It also will be appreciated that the first and second flexible sheets 26, 34 could be formed from one continuous sheet that is folded over upon itself, with further connections between the second (upper) sheet and the first (lower) sheet being made via any of the means of connection previously discussed.

In any of these configurations, the second flexible sheet 34 overlies and is connected to the first flexible sheet 26 and lies closely adjacent to the platform panel 6 in a pre-load configuration, before insertion of an article between the first and second flexible sheets 26, 34. Note that the second flexible sheet 34 need not be of the same material as the first flexible sheet 26, unless the two are integrally formed by folding over one continuous sheet. However, being of related materials may be helpful if the first and second flexible sheets will be connected by heat seal. Nevertheless, the ability to use different materials for the first and second flexible sheets permits use of specific materials for defined purposes, or less expensive sheet material for the first flexible sheet and potentially more expensive sheet material for the second flexible sheet, such as may be the case when utilizing a lesser grade of polyurethane for the first flexible sheet and a higher grade of polyurethane, such as one including a UV protection additive, for the second flexible sheet. As used herein, "different materials" is comprehensive and includes entirely different materials, as well as materials that are of the same basic components and differ in formulation.

For inserting an article between the first and second flexible sheets 26, 34, a region of the second flexible sheet, such as along one of the edges 28 that is proximate one of the second pair of side panels 22, 24, remains unconnected to the first flexible sheet 26. Accordingly, as may be seen in FIG. 1, an article A, which is generally depicted in FIG. 1 as a small box (but may be of any desired shape), may be inserted by lifting the free edge of the second flexible sheet 34 away from the first flexible sheet 26 and inserting the article A through the access opening provided and into the region between the flexible support panel 32 and the second flexible sheet 34. The lifting of the free edge may be increased by pivoting the side panels 14, 16 toward the first face 8 of the platform panel 6.

The size of the article A may cause the first and second flexible sheets to 26, 34 to stretch or the side panels 14, 16 to tend to pivot toward the first face 8 of the platform panel 6 to accommodate the thickness and contours of the article A. To hold the article A in place against the flexible support panel 32, the pair of opposed side panels 14, 16 are pivoted away from the first face 8 and toward the second face 10 of the platform panel 6 along the edges 12 of the platform panel 6, at fold lines or other lines of weakness. This increases the tension in the second flexible sheet 34 that is coupled to the side panels 14, 16. The tension in the second flexible sheet 34 will tend to force the article to press downward against the first flexible sheet 26 and the flexible support panel 32, which will allow some of the tension and stretch to be provided by the flexible support panel 32, by permitting an article to press downward and through the plane of the platform panel 6. This may relieve some of the stress on the second flexible sheet 34, which would otherwise have to bear all of the deformation to accommodate the article. The tension in the second flexible sheet 34 will tend to force the article A to press downward on the flexible support panel 32, which also will help hold the article A from shifting laterally and keep it located within the opening 18 in the platform panel 6, as the bottom of the article A will tend to be located inward of the edges 20 of the opening 18. The bottom and sides of the article A also are prevented from contacting the support frame 4, thereby avoiding potential abrasions, scuffing or other damage to the article A, which can otherwise occur when corrugated or non-corrugated fiberboard or cardboard is in contact with a surface and is subjected to extended intermittent motion. Also, the flexible support panel location over the opening 18 helps protect an article or product from shock that is due to impacts.

As seen in FIG. 3, with the article A inserted and the pair of side panels 14, 16 pivoted away from the first face 8 and toward the second face 10 of the platform panel 6, and the second pair of side panels 22, 24 pivoted toward the first face 8 of the platform panel 6, the packaging structure 2 is in a position for insertion into an outer container, such as a box, envelope or other suitable container for shipping, wherein the packaging structure will suspend the article A in a position where it is spaced from the outer walls of the container and safely secured within the packaging structure between the flexible support panel 32 and the second flexible sheet 34.

A method of making a packaging structure 2 that is adapted for insertion into an outer container, therefore, is provided. The method includes the steps of providing a support frame 4 having at least a platform panel 6 having first and second opposed faces 8,10 and an opening 18 therein, with the support frame 4 having at least a pair of opposed side panels 14, 16 pivotally connected to the platform panel 6. The method includes providing a first flexible sheet 26 adjacent to at least a portion of the first face 8 of the platform panel 6 and extending the first flexible sheet over and beyond the opening 18 therein, and connecting the first flexible sheet 26 to the support frame 4 between respective edges 28 of the first flexible sheet 26 and edges 20 of the opening 18, so as to form a flexible support panel 32 that is circumscribed by the platform panel 6. Additional steps of the method include providing a second flexible sheet 34 adjacent to the first flexible sheet 26 and coupling the second flexible sheet 34 to the pair of opposed side panels 14, 16.

The packaging structure 2 is used by inserting one or more articles A between the first and second flexible sheets 26, 34 and locating the one or more articles between the flexible support panel 32 and the second flexible sheet 34. The side panels 14, 16 then are pivoted away from the first face 8 and toward the second face 10 of the platform panel 6 to tension the second flexible sheet 34 and help hold the one or more articles A in position. If equipped with a second pair of opposed side panels 22, 24, then such side panels may be pivoted toward the first face 8 of the platform panel 6. The packaging structure 2 and the one or more articles A then are ready to be placed in an outer container for shipment. To provide additional cushioned support for the one or more articles A, the side panels 14, 16 may be pivoted beyond a vertical orientation, such as is shown with the example in FIG. 7, and placed in an outer container having an appropriate reduced height, so as to permit the packaging structure 2 to act as a spring suspension.

Figure 4:
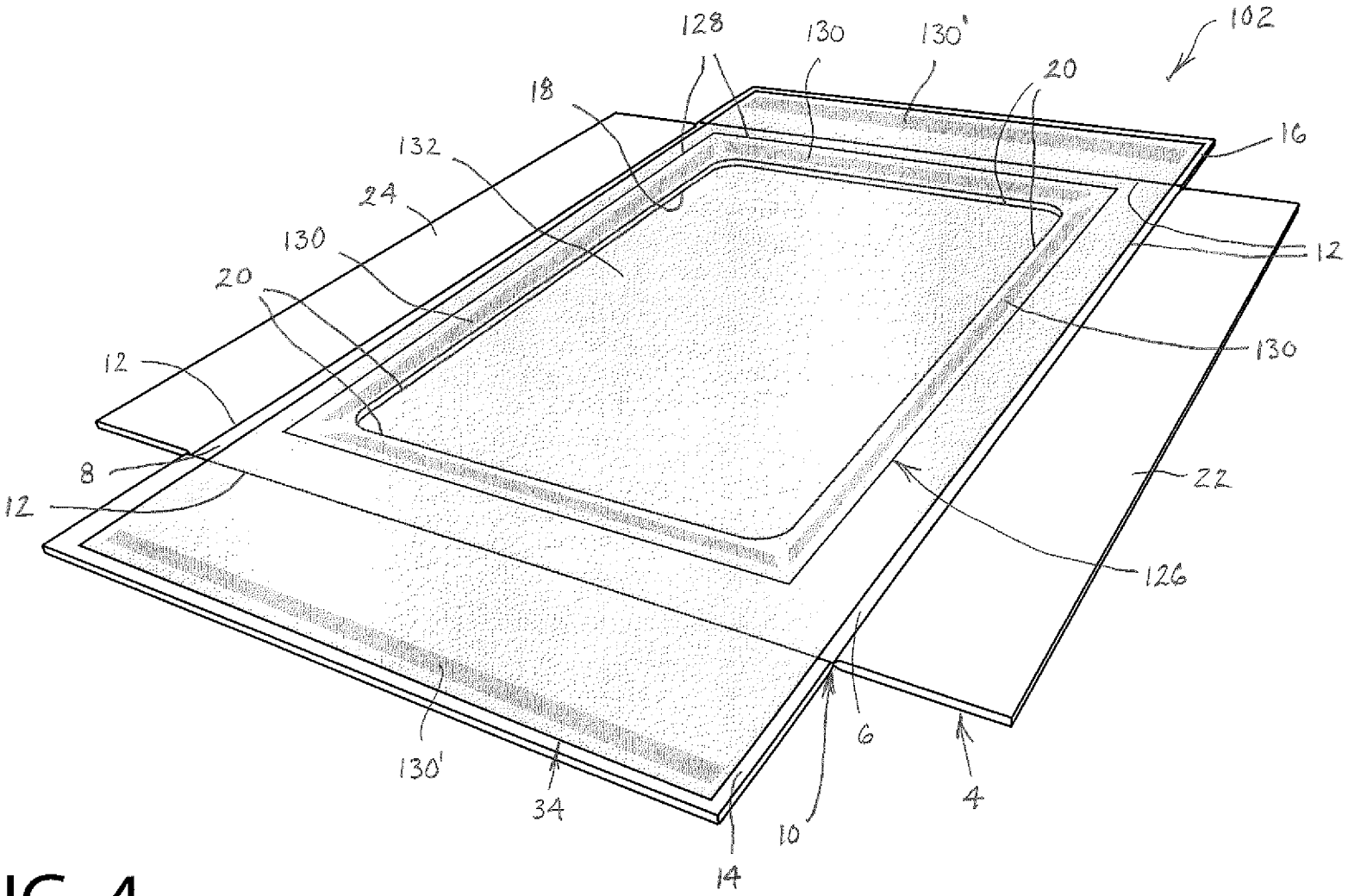
FIG. 4 is an upper perspective view of a second example of a packaging structure showing a first flexible sheet connected to a platform panel along opposed edges between edges of an opening in the platform panel and outer edges of the platform panel, and a second flexible sheet overlying the first flexible sheet and being connected to a first pair of opposed pivotable side panels.

FIG. 4 shows a second example packaging structure 102 which utilizes the same support frame 4 and second flexible sheet 34 as in the first example, but a different first flexible sheet 126 and coupling of the second flexible sheet 34 to the support frame 4. As illustrated, the first flexible sheet 126 is smaller than the first flexible sheet 26 of the first example, but it still is larger than the opening 18 in the platform panel 6. In this example, the first flexible sheet 126 is connected to the platform panel 6 using glue lines 130, located outside the edges 20 of the opening 18 but between the edges 128 of the first flexible sheet 126. In this manner, a flexible platform support 132 is formed by connecting the first flexible sheet 126 to the platform panel 6. The opening 18 further causes the platform panel 6 to lack substantial rigidity. This is followed by coupling the second flexible sheet 34 to the pivotally connected opposed side panels 14, 16. In this example, additional glue lines 130' are used to connect the second flexible sheet 34 to the side panels 14, 16.

Figure 7:
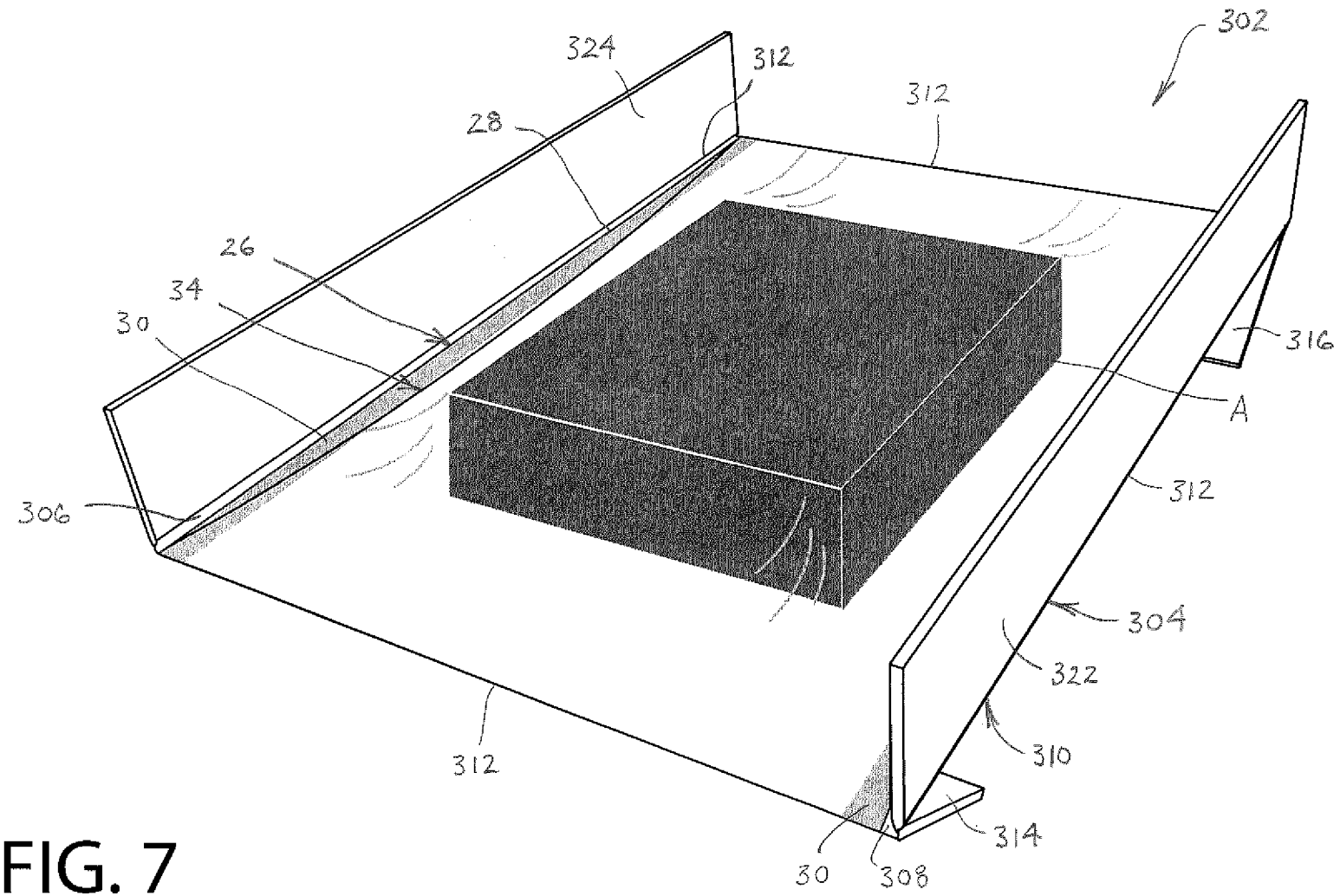
FIG. 7 is a further upper perspective view of the example shown in FIG. 6 but having the opposed side panels pivoted away from the first face of the support panel and toward a second face of the platform panel, such that with the tension in the first and second flexible sheets, a spring suspension is provided for the platform panel, while second opposed side panels are pivoted toward the first face of the platform panel, illustrating a configuration in which the support frame is ready for insertion of the packaging structure into an outer container to support the article on the support frame between upper and lower walls of the outer container.

Similar methods of making and use of a packaging structure are employed with the packaging structure 102, in comparison to the packaging structure 2. The differences between the two examples were highlighted above and relate to the second example using a smaller size for the first flexible sheet 126, and to the first and second flexible sheets 126, 34 not being connected to each other. The materials used in the second example for the components and to connect the components may be as described with respect to the first example, as well. Also, additional cushioning may be provided in the same manner discussed with respect to the first example, and as shown in FIG. 7, where side panels are pivoted beyond a vertical orientation, so as to be angled and to create a spring suspension below the second face 10 of the platform panel 6.

Figure 5:
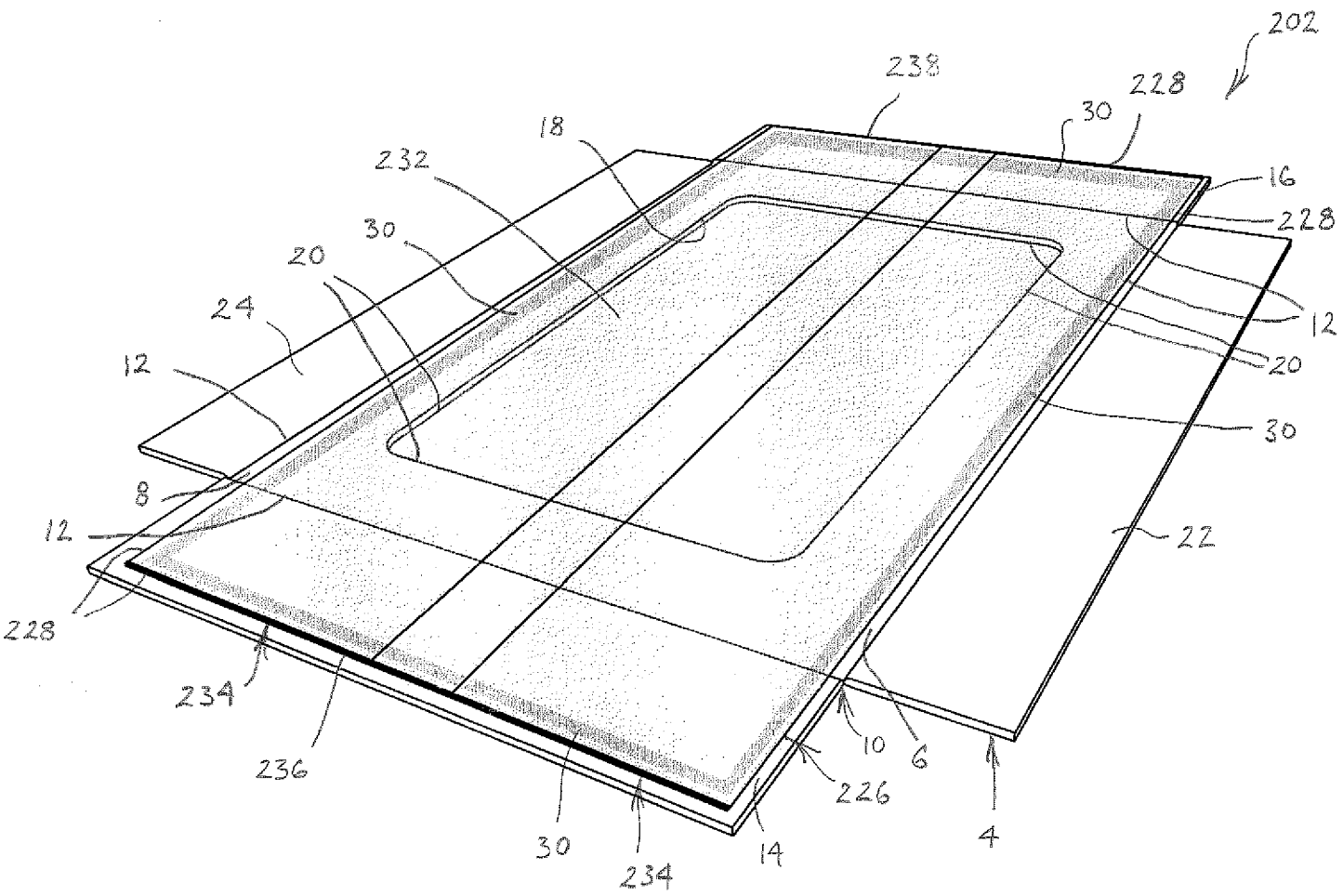
FIG. 5 is an upper perspective view of a third example of a packaging structure showing a first flexible sheet connected to opposed pivotable side panels along first opposed edges of the first flexible sheet and connected to a platform panel along second opposed edges of the first flexible sheet, with at least a second flexible sheet being integrally formed with and folded over at least a portion of the first flexible sheet and further being connected to the first flexible sheet proximate the opposed side panels.

Turning to FIG. 5, a third example packaging structure 202 is illustrated. For ease of explanation, the packaging structure 202 again utilizes the same support frame 4, however, this example uses first and second flexible sheets 226, 234 that are integrally formed as part of a single flexible sheet. To prepare the first and second flexible sheets 226, 234, the single flexible sheet generally should be larger than the face of the platform panel 6, and the single flexible sheet is folded over proximate the two opposed edges 12 where the second pair of opposed side panels 22, 24 are pivotally connected to the platform panel 6. As such, in this third example, the first flexible sheet 226 lies adjacent the support frame, and the second flexible sheet 234 actually includes two portions that overlap each other and lie over the first flexible sheet 226. The two overlying portions of the second flexible sheet 234 are heat sealed to the underlying first flexible sheet 226, to generally form an envelope. It will be appreciated that the single flexible sheet alternatively could be folded over to form a configuration that defines a second flexible sheet having only one portion that overlies the first flexible sheet, or having two portions that overlie the first flexible sheet but that do not overlap each other.

In the example illustrated in FIG. 5, the first flexible sheet 226 is connected to the support frame 4 by glue lines 30 that are located within the area bounded by edges 228 of the first flexible sheet 226, with the glue lines 30 passing over the platform panel 6 and side panels 14, 16. However, the connection of the first flexible sheet to the support frame could be by other suitable connection means previously discussed. This connection allows the first flexible sheet 226 to form a flexible support panel 232 within the edges 20 of the opening 18 in the platform panel 6. The opening 18 also causes the platform panel 6 to lack substantial rigidity. In this example, the two overlapping portions of the second flexible sheet 234 are coupled to the opposed side panels 14, 16 by heat seals 236, 238 to the first flexible sheet 226, which as previously mentioned, is connected to the side panels 14, 16 and platform panel 6 by glue lines 30, in the same manner as for the first example.

A similar method of making a packaging structure is employed with the packaging structure 202, in comparison to the packaging structure 2. The differences between the examples were evident within the description of the third example and relate to it using a larger flexible sheet that provides the first flexible sheet 226 and the second flexible sheet 234, with the first and second flexible sheets 226, 234 being integrally formed and being further connected to each other along the edges that are proximate the side panels 14, 16. In addition, the materials used in the second example for the components and to connect the components may be as described with respect to the first example.

With respect to use of the packaging structure 202, there are some differences relative to use of the packaging structure 2 of the first example. For instance, in the third example, the access opening along at least one of the edges of the second flexible sheet 234 is not located proximate a fold line 12 of one or both of the second pair of side panels 22, 24, but rather is located where the two portions of the second flexible sheet overlap. Thus, an article may be inserted through the access opening along the overlap of the two portions of the second flexible sheet 234 and the article will be placed between the flexible support panel 232 and the second flexible sheet 234.

As with the first example, the side panels 14, 16 then are pivoted away from the first face 8 and toward the second face 10 of the platform panel 6 to tension the second flexible sheet 234 and help hold one or more articles in position, within the opening 18 in the platform panel 6. As with the prior examples, if equipped with a second pair of opposed side panels 22, 24, then the side panels may be pivoted toward the first face 8 of the platform panel 6 as the packaging structure 202 is placed in an outer container for shipment. Also, as with the prior examples, additional cushion may be provided for the one or more articles by pivoting the side panels 14, 16 beyond a vertical orientation, such as is shown with the example in FIG. 7, and by then placing the packaging structure 202 in an outer container having an appropriate reduced height, so as to permit the packaging structure 202 to act as a spring suspension.

It will be appreciated that the second flexible sheet could be formed so as to be folded over along the outer edges, as shown in the third example, but with portions that do not overlap each other. This would still permit one or more articles to be inserted between the second flexible sheet and the flexible support panel. Additionally, the second flexible sheet could be formed to include a single portion that folds over along one outer edge and overlaps at least a portion of the first flexible sheet, leaving at least one access opening to insert one or more articles between the second flexible sheet and the flexible support panel. Thus, there are alternative configurations for forming the first and second flexible sheets, and for connecting the first flexible sheet to the support frame, and for coupling the second flexible sheet to the side panels.

Figure 6:
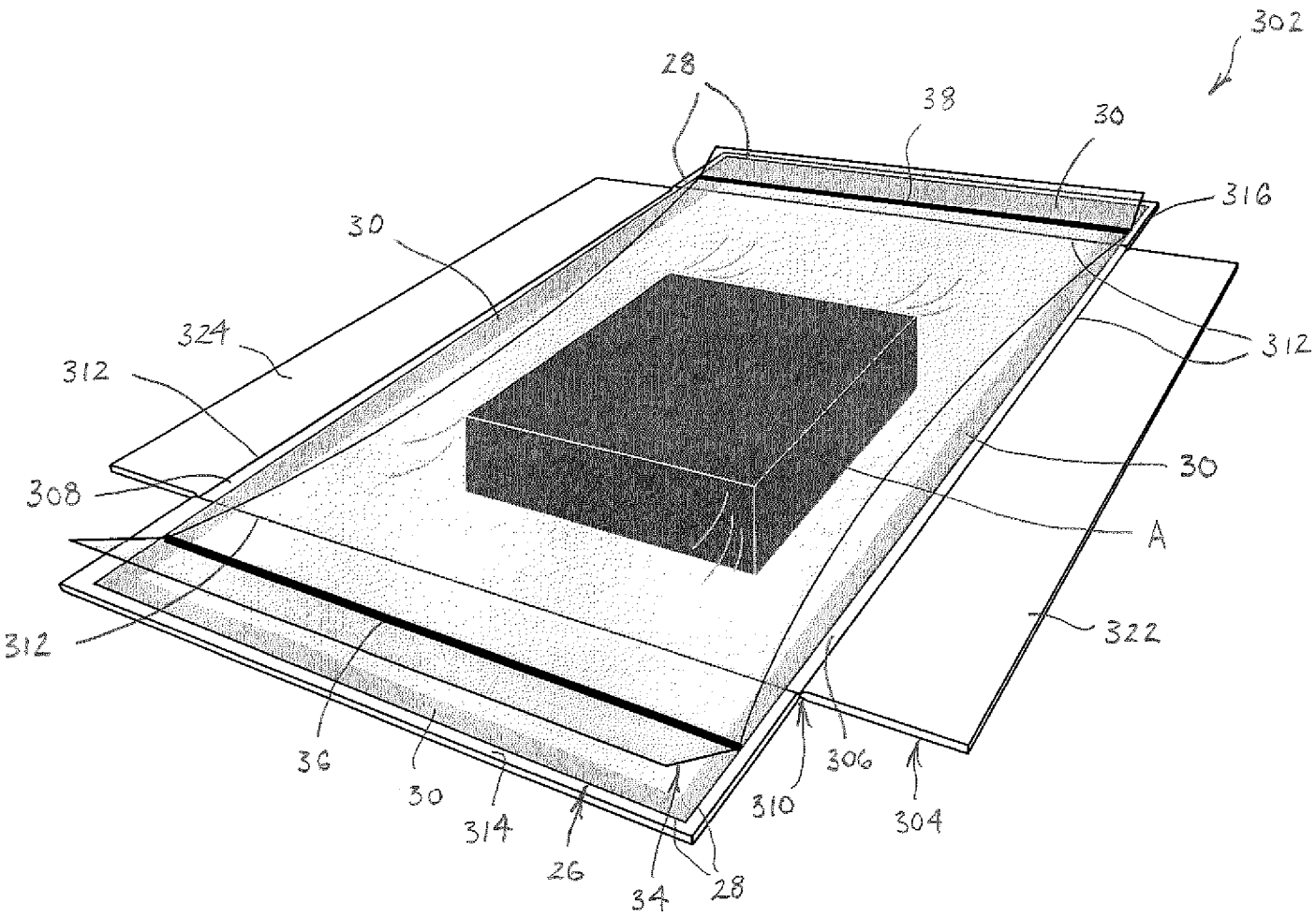
FIG. 6 is an upper perspective view of a fourth example of a packaging structure that is of similar construction to the packaging structure shown in FIGS. 1-3 but without an opening in the platform panel.

Now turning to FIGS. 6 and 7 a fourth example packaging structure 302 is illustrated as being constructed in a manner similar to the way the first example packaging structure is constructed, but without an opening in the platform panel. Thus, for convenience of explanation, a different support frame 304 is illustrated, but the first and second flexible sheets 26, 34 and their connection to each other and to the support frame 304 is similar to the first example.

Accordingly, a support frame 304 has at least a platform panel 306 having first and second opposed faces 308, 310, and outer edges 312. The platform panel 306 also is pivotally connected to a pair of opposed side panels 314, 316, such as along fold lines or other lines of weakness at the outer edges 312 of the platform panel 306, as previously discussed with the other examples. The support frame 304 may be constructed of any suitable relatively rigid material, as discussed with respect to the other examples and may incorporate multiple materials for particular purposes.

The platform panel 306 is not shown with a central opening to form a flexible support panel, although a first flexible sheet does provide a non-abrasive surface for an article A. The illustrated example platform panel 306 generally is rectangular in shape but, as with the other examples, it will be appreciated the actual shape used for the platform panel may be varied and the platform panel may include openings therethrough, as the particular packaging requirements demand. The support frame 304 also may be pivotally connected to a second pair of opposed side panels 322, 324. The support frame 304 has an overall length in a first direction that includes the platform panel 306 and the pair of opposed side panels 314, 316 when the platform panel 306 and side panels 314, 316 are disposed in a planar orientation, such as is shown in FIG. 6.

A first flexible sheet 26 may be constructed of any suitable flexible material, as discussed above with respect to the first example. The first flexible sheet 26 has outer edges 28 and an overall length in the first direction that is less than or equal to that of the support frame 304, including the platform panel 306 and the pair of side panels 314, 316 when disposed in a planar orientation. The first flexible sheet 26 also is less than or equal to the width of the platform panel 306 in a direction perpendicular to the first direction. This configuration allows the first flexible sheet 26 to be connected to the support frame 304 at locations inward of the outer edges 28 of the first flexible sheet 26.

In this example, as may be seen in FIG. 6, the first flexible sheet 26 is connected to the pair of opposed pivotable side panels 314, 316 along two respective edges 28, and connected to the platform panel 306 along two other respective edges 28. As such, the connection of the first flexible sheet may be made to a single side of the support frame 304 in a very efficient and cost effective manner by use of adhesive, in the form of glue lines 30, or other suitable means of connection, which may be continuous or intermittent in pattern, as discussed with respect to the other examples. As illustrated, glue lines 30 may be applied to the support frame 304 generally along and parallel to the edges 28 of the first flexible sheet 26. The flexible film is brought into contact with the support frame 304 and attached thereto along the glue lines 30. Also, it will be appreciated, that the first flexible sheet may be shorter in length than the platform panel and even short than the platform panel 306, but should be large enough to prevent direct contact between the article A and the platform panel 306, which may otherwise cause abrasions or scuffing.

A second flexible sheet 34 is provided, as discussed with respect to the first example, and has a length in the first direction that is generally less than or equal to the length of the support frame 304, including the platform panel 306 and the pair of side panels 314, 316 when disposed in a planar orientation. The second flexible sheet 34 is coupled to the pair of opposed pivotable side panels 314, 316. In this fourth example, with a first flexible sheet 26 that extends over the side panels 314, 316, this may be accomplished in at least the two ways set forth with respect to the first example, wherein the first and second flexible sheets 26, 34 could be connected together and then the first flexible sheet 26 could be connected to the support frame 304, or the first flexible sheet 26 could be connected to the support frame 304, followed by the second flexible sheet 34 being connected to the first flexible sheet 26. It will be appreciated that any of the means of connecting the flexible sheets to each other or to the support frame may be utilized. It also will be appreciated that the first and second flexible sheets could be integrally formed from one continuous sheet that is folded over upon itself, and with still further connections between the second (upper) sheet and the first (lower) sheet, as discussed with respect to the previous examples. In any of these configurations, the second flexible sheet 34 overlies the first flexible sheet 26 and lies closely adjacent to the platform panel 306 in a pre-loading configuration, before insertion of an article between the first and second flexible sheets 26, 34.

As with the previous examples, an article may be inserted between the first and second flexible sheets 26, 34 in a region of the second flexible sheet that remains unconnected to the first flexible sheet 26, such as along one of the edges 28 that is proximate one of the second pair of side panels 322, 324. Accordingly, as may be seen in FIG. 6, an article A, may be inserted by lifting the free edge of the second flexible sheet 34 away from the first flexible sheet 26 and inserting the article A through the access opening provided and into the region between the first and second flexible sheets 26, 34. The lifting of the free edge may be increased by pivoting the side panels 314, 316 toward the first face 308 of the platform panel 306.

The size of the article A may cause the first and second flexible sheets to 26, 34 to stretch or the side panels 314, 316 to tend to pivot toward the first face 308 of the platform panel 306 to accommodate the thickness and contours of the article A. To hold the article A in place against the first flexible sheet 26 that overlies the platform panel 306, the pair of opposed side panels 314, 316 are pivoted away from the first face 308 and toward the second face 310 of the platform panel 306 along the edges 312 of the platform panel 306, at fold lines or other lines of weakness. This increases the tension in the second flexible sheet 34 that is coupled to the side panels 314, 316. The tension in the second flexible sheet 34 will tend to force the article A to press downward against the first flexible sheet 26 and the platform panel 306, which will help hold the article A from shifting laterally. The bottom of the article A also is prevented from contacting the platform panel 306, thereby avoiding potential abrasions, scuffing or other damage to the article A.

As seen in FIG. 7, with the article A inserted and the pair of side panels 314, 316 pivoted away from the first face 308 and toward the second face 310 of the platform panel 306 and the second pair of side panels 322, 324 pivoted toward the first face 308 of the platform panel 306, the packaging structure 302 is in a position for insertion into an outer container, such as a box, envelope or other suitable container for shipping. The packaging structure 302 will suspend the article A in a position where it is spaced from the outer walls of the container and safely secured within the packaging structure between the first and second flexible sheets 26, 34. In this fourth example, the support frame 304 also is shown in FIG. 7 in a position that achieves additional cushioning by having the side panels 314, 316 pivoted to a position extending at an angle below the platform panel 306 to provide a spring suspension.

Similar methods of making and use of a packaging structure are employed with the packaging structure 302, in comparison to the packaging structure 2, but the packaging structure 302 does not provide a flexible support panel, as is illustrated with flexible support panel 32 in the first example. Although described in terms of preferred and alternate embodiments, the present subject matter may be employed in other configurations and with other materials without departing from the principles of the subject matter as described above and as set forth in the following claims.

Figure 8:
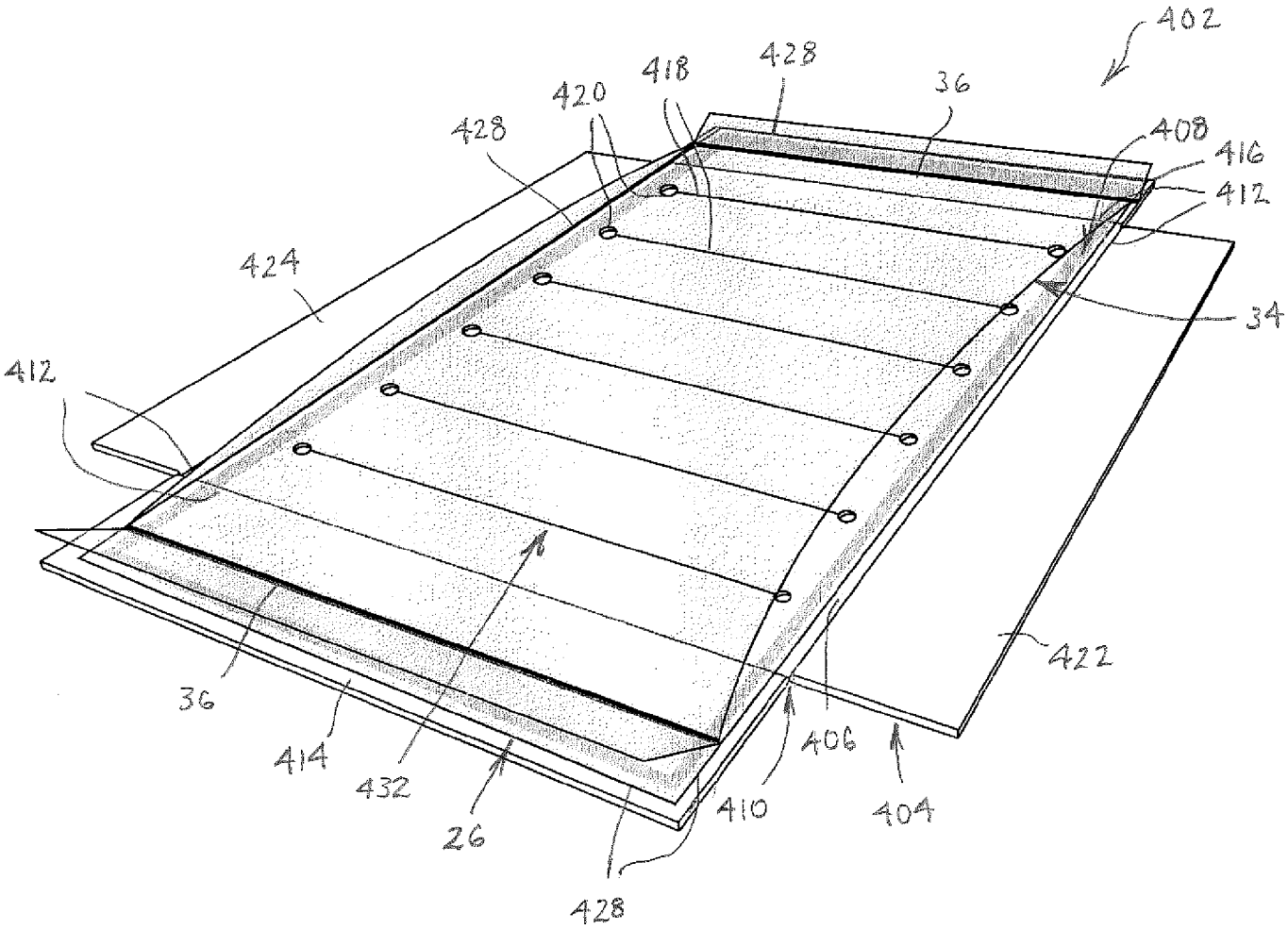
FIG. 8 is an upper perspective view of a fifth example of a packaging structure that is of somewhat similar construction to the packaging structure shown in FIGS. 6-7 but includes lateral slits, spaced apart longitudinally, that define a weakened zone lacking substantial rigidity and provide a flexible support panel.

Now turning to FIG. 8, a fifth example packaging structure 402 is illustrated as being constructed in a manner somewhat similar to the way the first example packaging structure is constructed. Accordingly, the packaging structure 402 includes a support frame 404 having at least a platform panel 406 having first and second opposed faces 408, 410, and outer edges 412. The platform panel 406 also is pivotally connected to a pair of opposed side panels 414, 416, such as along fold lines or other lines of weakness, which may be formed in a manner as discussed with respect to the above first example. The support panel 404 also may be constructed of various different materials, as discussed above with respect to the first example packaging structure 2.

In this fifth example, the platform panel 406 includes at least one opening or aperture 418 therethrough which includes edges 420. In this example, the platform panel 406 has a weakened zone that is defined by a plurality of lateral slits or openings 418, spaced apart longitudinally. The slits 418 are shown as being elongated and having parallel side edges, with the ends flaring into a larger generally circular-shaped opening at each end. Such flared openings at the ends of the slits 418 reduce stress concentration and provide increased resistance to tearing of the platform panel 406. The slits 418 may be continuous or intermittent, and are sufficiently numerous and spaced appropriately to provide a weakened zone that forms a flexible support panel 432 in the region of the slits 418. The flexible support panel 432 permits some flexible suspension of an article to be placed within the packaging structure 402, but lacks substantial rigidity, and indeed causes the platform panel 406 to lack substantial rigidity. The slits 418 also may be varied as the particular packaging requirements demand, so as to take advantage of the flexibility in the support panel 432.

The platform panel 406 also may be pivotally connected to a second pair of opposed side panels 422, 424. As with the prior examples, the support frame 404 has an overall length in a first direction that includes the platform panel 406 and the pair of opposed side panels 414, 416 when the platform panel 406 and side panels 414, 416 are disposed in a planar orientation, such as is shown in FIG. 8.

A first flexible sheet 26 is provided, as discussed above with respect to the first example. The first flexible sheet 26 is connected to the pair of opposed pivotable side panels 414, 416 along two respective outer edges 428, and connected to the platform panel 406 along two other respective edges 428, such that the connection of the first flexible sheet 26 also is between the outer edges 428 of the first flexible sheet 26 and the edges 420 of the weakened zone formed by the slits 418 in the platform panel 406. Thus, the first flexible sheet 26 preferably has dimensions relative to the support frame 404 that are similar to the dimensions discussed with respect to the first example, or at least sufficient to circumscribe the weakened zone that contains the slits 418 and forms the flexible support panel 432. The connection of the first flexible sheet 26 to the support frame 404 may be made to a single side of the support frame 404 in a very efficient and cost effective manner, such as by use of glue or other materials and methods, as described with respect to the prior examples.

A second flexible sheet 34 is provided, and is constructed of materials and dimensioned in the manner discussed with respect to the first example. The second flexible sheet 34 is shown as being coupled to the pair of opposed pivotable side panels 414, 416 by use of heat seals 36 to the first flexible sheet 26, which in turn is connected to the side panels 414, 416. In this fifth example, the first and second flexible sheets 26, 34 could be connected together and coupled to the side panels 414, 416 by any of the methods discussed with respect to the first example. In any of the configurations, the second flexible sheet 34 overlies the first flexible sheet 26 and lies closely adjacent to the platform panel 406 preferably in a pre-loading configuration, before insertion of an article between the first and second flexible sheets 26, 34.

As with the previous examples, an article may be inserted between the first and second flexible sheets 26, 34 in a region of the second flexible sheet 34 that remains unconnected to the first flexible sheet 26, such as is shown in FIG. 8 where the second flexible sheet 34 is shown being slightly lifted along each of the edges 28 that are proximate one of the second pair of side panels 422, 424. Indeed, as noted with respect to prior examples, the lifting of the free edge may be increased by pivoting the side panels 414, 416 toward the first face 408 of the platform panel 406.

To hold an article in place against the first flexible sheet 26 that overlies the flexible support panel 432, the pair of opposed side panels 414, 416 are pivoted away from the first face 408 and toward the second face 410 of the platform panel 406 along the edges 412 of the platform panel 406, at fold lines or other lines of weakness. This increases the tension in the second flexible sheet 34. The tension in the second flexible sheet 34 will tend to force the article to press downward against the first flexible sheet 26 and the weakened zone that forms the flexible support panel 432. Because the weakened zone lacks substantial rigidity, it will allow some tension and stretch to be provided within the weakened zone and the first flexible sheet 26, and permit an article to press downward and through the original plane of the platform panel 406. This may have the benefit of relieving some of the stress on the second flexible sheet 34, which would otherwise have to bear all of the deformation to accommodate the article if the support panel were substantially rigid. This also will help hold the article from shifting laterally. In addition, the bottom of the article generally will be prevented from contacting the platform panel 406, thereby avoiding potential abrasions, scuffing or other damage to the article.

With an article inserted and the pair of side panels 414, 416 pivoted away from the first face 408 and toward the second face 410 of the platform panel 406 and the second pair of side panels 422, 424 pivoted toward the first face 408 of the platform panel 406, the packaging structure 402 would be in a position for insertion into an outer container, such as a box, envelope or other suitable container for shipping, similar to the position shown for the example in FIG. 3. The packaging structure 402 will suspend the article in a position where it is spaced from the outer walls of the container and safely secured within the packaging structure between the first and second flexible sheets 26, 34. It will be appreciated that the support frame 404 also may provide additional cushioning by having the side panels 414, 416 pivoted to a position extending at an angle below the platform panel 406 to provide a spring suspension, similar to the position shown for the example in FIG. 7.

Figure 9:
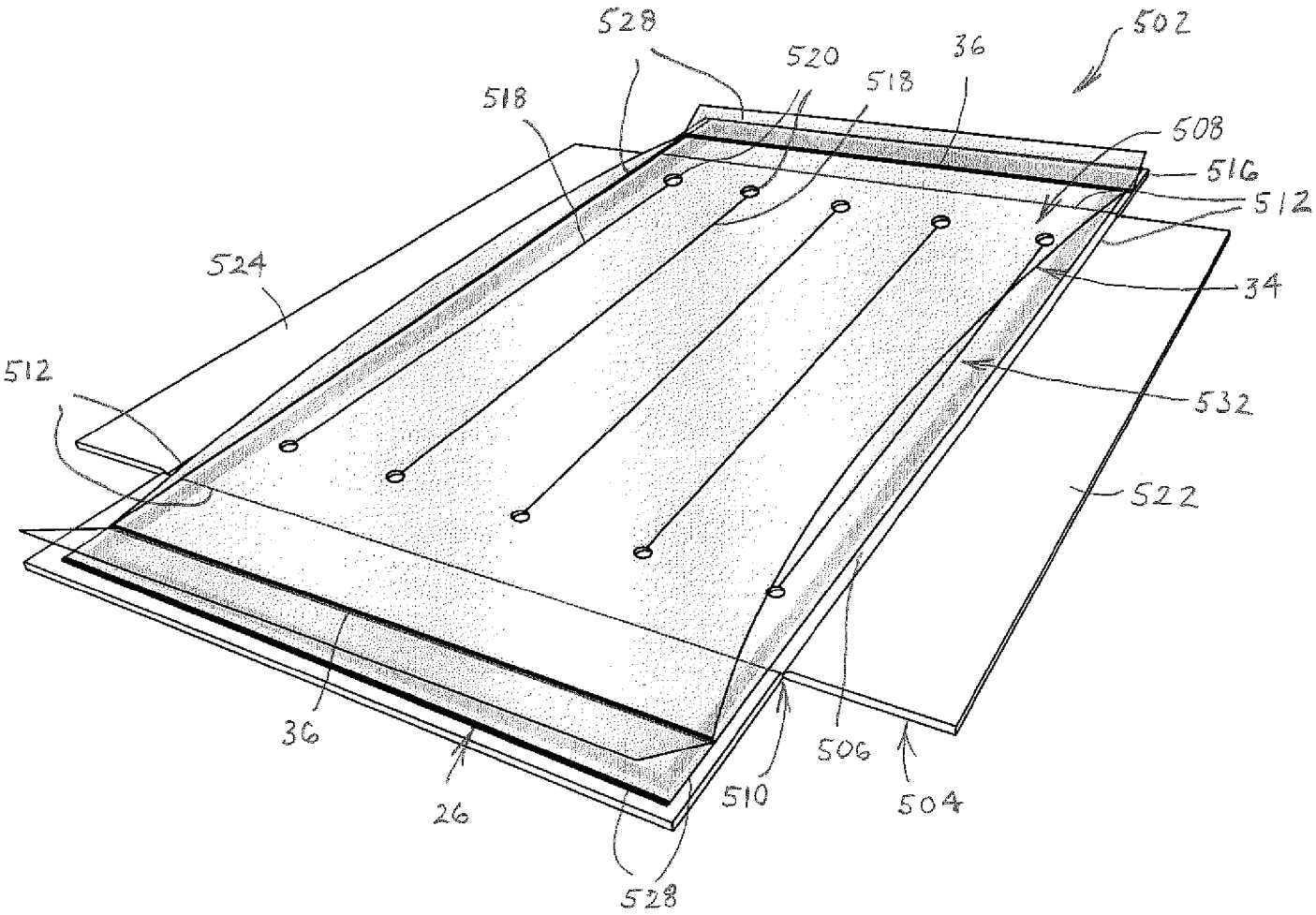
FIG. 9 is an upper perspective view of a sixth example of a packaging structure that is of somewhat similar construction to the packaging structure shown in FIG. 9 but includes longitudinal slits, spaced apart laterally, that define a weakened zone lacking substantial rigidity and provide a flexible support panel.

Now turning to FIG. 9, a sixth example packaging structure 502 is illustrated as being constructed with a support frame 504 having a platform panel 506 and in a manner somewhat similar to the way the fifth example packaging structure is constructed. Accordingly, the packaging structure 502 includes a support frame 504 having at least a platform panel 506 having first and second opposed faces 508, 510, and outer edges 512. The platform panel 506 also is pivotally connected to a pair of opposed side panels 514, 516, such as along fold lines or other lines of weakness, which may be formed in a manner as discussed with respect to the above first example. The support panel 504 also may be constructed of various different materials, as discussed above with respect to the first example packaging structure 2. However, the weakened zone in the platform panel 506 of the sixth example includes a plurality of longitudinal slits or openings 518, spaced apart laterally.

The slits 518 are shown as being elongated and having parallel side edges 520, with the optional flaring of the ends into a larger generally circular-shaped opening to help resist tearing. Similarly to the fifth example, the slits 518 may be continuous or intermittent, and define a zone of weakness that forms a flexible support panel 532 that lacks substantial rigidity and permits some flexible suspension of an article to be placed within the packaging structure 502, in contrast to a substantially rigid panel or backing. The slits 518 also may be varied as the particular packaging requirements demand, so as to take advantage of the flexibility in the support panel 532. The platform panel 506 also may be pivotally connected to a second pair of opposed side panels 522, 524. As with the prior examples, the support frame 504 has an overall length in a first direction that includes the platform panel 506 and the pair of opposed side panels 514, 516 when the platform panel 506 and side panels 514, 516 are disposed in a planar orientation, such as is shown in FIG. 9.

The construction, dimensions and coupling of the first flexible sheet 26 and second flexible sheet 34 to the support frame 504 of the sixth example are similar to those shown and described for the fifth example shown in FIG. 8. Thus, the first flexible sheet 26 is connected to the pair of opposed pivotable side panels 514, 516 along two respective outer edges 528, and connected to the platform panel 506 along two other respective edges 528, such that the connection of the first flexible sheet 26 also is between the outer edges 528 of the first flexible sheet 26 and the edges 520 of the respective at least one opening, in the form of the slits 518. As with the prior examples, this permits connection of the first flexible sheet 26 to a single side of the support frame 504 in a very efficient and cost effective manner, such as by use of glue or other materials and methods, as described with respect to the prior examples. The second flexible sheet 34 is shown as being coupled to the pair of opposed pivotable side panels 514, 516 by use of heat seals 36 to the first flexible sheet 26, which in turn is connected to the side panels 514, 516. It will be appreciated that other methods of connection of the first and second flexible sheets 26, 34 could be utilized, consistent with the discussion of the prior examples, resulting in the second flexible sheet 34 overlying the first flexible sheet 26.

The loading of an article between the first and second flexible sheets 26, 34 may be accomplished, as discussed with respect to the prior examples, by sliding an article therebetween in a region of the second flexible sheet 34 that remains unconnected to the first flexible sheet 26. To hold an article in place against the first flexible sheet 26 that overlies the support panel 532, the pair of opposed side panels 514, 516 are pivoted away from the first face 508 and toward the second face 510 of the platform panel 506 along the edges 512 of the platform panel 506, at fold lines or other lines of weakness. This increases the tension in the second flexible sheet 34. The tension in the second flexible sheet 34 will tend to force the article to press downward against the first flexible sheet 26 and the weakened zone that forms the flexible support panel 532. Because the weakened zone lacks substantial rigidity, it will allow some tension and stretch to be provided within the weakened zone that defines the support panel 532 and the first flexible sheet 26, and permit an article to press downward and through the original plane of the platform panel 506. As discussed with respect to the prior example, this may have the benefit of relieving some of the stress on the second flexible sheet 34, which would otherwise have to bear all of the deformation to accommodate the article if the support panel were substantially rigid. This also will help hold the article from shifting laterally, and the first flexible sheet 26 generally will prevent the bottom of the article from contacting the platform panel 506, thereby avoiding potential abrasions, scuffing or other damage to the article.

As with the prior examples, with an article inserted between the first and second flexible sheets 26, 34 and the pair of side panels 514, 516 pivoted away from the first face 508 and toward the second face 510 of the platform panel 506, and the second pair of side panels 522, 524 pivoted toward the first face 508 of the platform panel 506, the packaging structure 502 may be moved to a position that is similar to that shown in FIG. 3, for insertion into an outer container, such as a box, envelope or other suitable container for shipping. The packaging structure 502 will suspend the article in a position where it is spaced from the outer walls of the container and safely secured within the packaging structure between the first and second flexible sheets 26, 34. Additional cushioning may be provided by having the side panels 514, 516 pivoted to a position extending at an angle below the platform panel 506 to provide a spring suspension, similar to the position shown for the example in FIG. 7.

Figure 10:
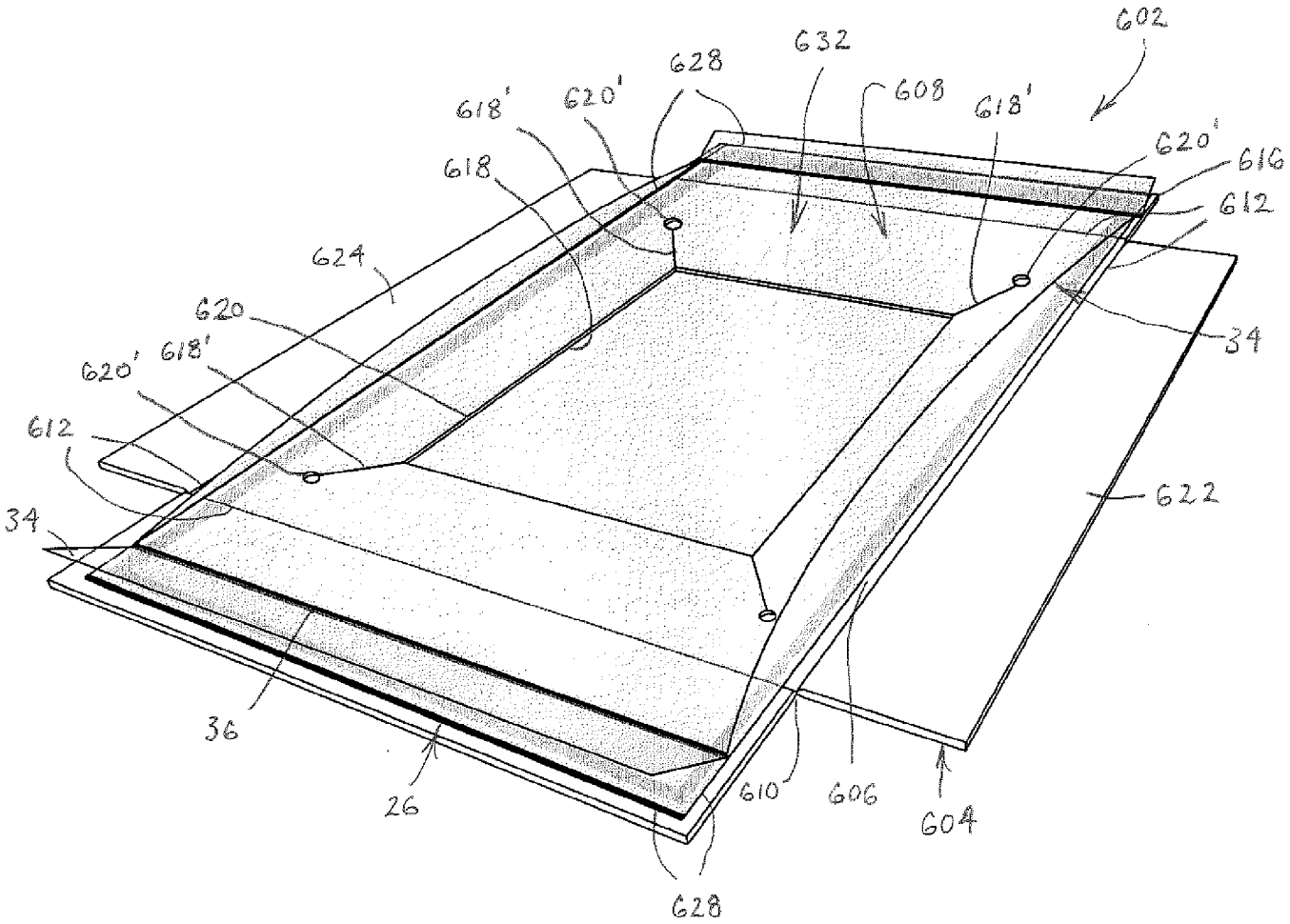
FIG. 10 is an upper perspective view of a seventh example of a packaging structure that is of somewhat similar construction to the packaging structure shown in FIGS. 1-3, but further includes slits or openings that extend in angular orientations to each other and that define a combination opening and weakened zone lacking substantial rigidity and provide a flexible support panel.

Turning to FIG. 10, a seventh example packaging structure 602 includes a support frame 604 having at least a platform panel 606 having first and second opposed faces 608, 610, and outer edges 612. The platform panel 606 is pivotally connected to a pair of opposed side panels 614, 616, such as along fold lines or other lines of weakness, which may be formed in a manner as discussed with respect to the above first example. The platform panel 606 also may be pivotally connected to a second pair of opposed side panels 622, 624. As with the prior examples, the support frame 604 has an overall length in a first direction that includes the platform panel 606 and the pair of opposed side panels 614, 616 when the platform panel 606 and side panels 614, 616 are disposed in a planar orientation, such as is shown in FIG. 10. The support frame 604 also may be constructed of various different materials, as discussed above with respect to the first example packaging structure 2.

The packaging structure 602 is illustrated as being constructed in a manner wherein the platform panel 606 includes an opening and a weakened zone within the platform panel. More specifically, the illustrated structure includes at least one enlarged opening 618, preferably centrally located and generally having edges 620. The platform panel 606 further includes slits or other openings or lines of weakness 618' that extend in angular orientations to each other and from respective corners of the opening 618. It will be appreciated that the angled slits 618' could be directly in communication with each other, but in this example, the slits 618' are in communication with and extend from the enlarged opening 618 toward the respective outer corners of the platform panel 606. The slits 618' are shown as being elongated and having parallel side edges 620', with the ends toward the corners of the platform panel 606 flaring into a larger generally circular-shaped opening, to resist tearing. The area of the panel generally between the edges 620 of the opening 618 and the outer ends of the slits 618' defines a weakened zone around the opening 620. The weakened zone is broadly in the form of bendable flaps having free edges defined by adjacent slits 618' and the edge of opening 618 extending between them. The opening 618 and weakened zone formed by the slits 618' also cause the platform panel 606 to lack substantial rigidity.

In this seventh example, the area of the platform panel 606 that includes the angled slits 618' and the optional opening 618 together provide a flexible support panel 632 that permits some flexible suspension of an article to be placed within the packaging structure 602, in contrast to a substantially rigid panel or backing. The slits 618, 618' may be of varied length and width, and may be intermittent or continuous, as the particular packaging requirements demand, so as to take advantage of the flexibility in the support panel 632.

The construction, dimensions and coupling of the first flexible sheet 26 and second flexible sheet 34 to the support frame 604 of the seventh example are similar to those shown and described for the fifth example shown in FIG. 8. Thus, the first flexible sheet 26 is connected to the pair of opposed pivotable side panels 614, 616 along two respective outer edges 628, and connected to the platform panel 606 along two other respective edges 628, such that the connection of the first flexible sheet 26 also is between the outer edges 628 of the first flexible sheet 26 and the edges 620, 620' of the respective at least one opening, in the form of the slits 618, 618'. As with the prior examples, this permits connection of the first flexible sheet 26 to a single side of the support frame 604 in a very efficient and cost effective manner, such as by use of glue or other materials and methods, as described with respect to the prior examples. As discussed and shown with respect to some of the prior examples, the second flexible sheet 34 is shown as being coupled to the pair of opposed pivotable side panels 614, 616 by use of heat seals 36 to the first flexible sheet 26, which in turn is connected to the side panels 614, 616. It will be appreciated that other methods of connection of the first and second flexible sheets 26, 34 could be utilized, consistent with the discussion of the prior examples, resulting in the second flexible sheet 34 overlying the first flexible sheet 26.

The loading of an article between the first and second flexible sheets 26, 34 may be accomplished, as discussed with respect to the prior examples, by sliding an article therebetween in a region of the second flexible sheet 34 that remains unconnected to the first flexible sheet 26. To hold an article in place against the first flexible sheet 26 that overlies the support panel 632, the pair of opposed side panels 614, 616 are pivoted away from the first face 608 and toward the second face 610 of the platform panel 606 along the edges 612 of the platform panel 606, at fold lines or other lines of weakness. This increases the tension in the second flexible sheet 34. The tension in the second flexible sheet 34 will tend to force the article to press downward against the first flexible sheet 26 at the weakened zone and opening, which will allow some of the tension and stretch to be accommodated by the flexible support panel 632 and the first flexible sheet 26, by permitting an article to press downward and through the original plane of the platform panel 606. This may relieve some of the stress on the second flexible sheet 34, which would otherwise have to bear all of the deformation to accommodate the article. This also will help hold the article from shifting laterally, and the first flexible sheet 26 will prevent the article from contacting the platform panel 606, thereby avoiding potential abrasions, scuffing or other damage to the article.

As with the prior examples, with an article inserted between the first and second flexible sheets 26, 34 and the pair of side panels 614, 616 pivoted away from the first face 608 and toward the second face 610 of the platform panel 606, and the second pair of side panels 622, 624 pivoted toward the first face 608 of the platform panel 606, the packaging structure 602 may be moved to a position that is similar to that shown in FIG. 3, for insertion into an outer container, such as a box, envelope or other suitable container for shipping. The packaging structure 602 will suspend the article in a position where it is spaced from the outer walls of the container and safely secured within the packaging structure between the first and second flexible sheets 26, 34. Additional cushioning may be provided by having the side panels 614, 616 pivoted to a position extending at an angle below the platform panel 606 to provide a spring suspension, similar to the position shown for the example in FIG. 7.

Figure 11:
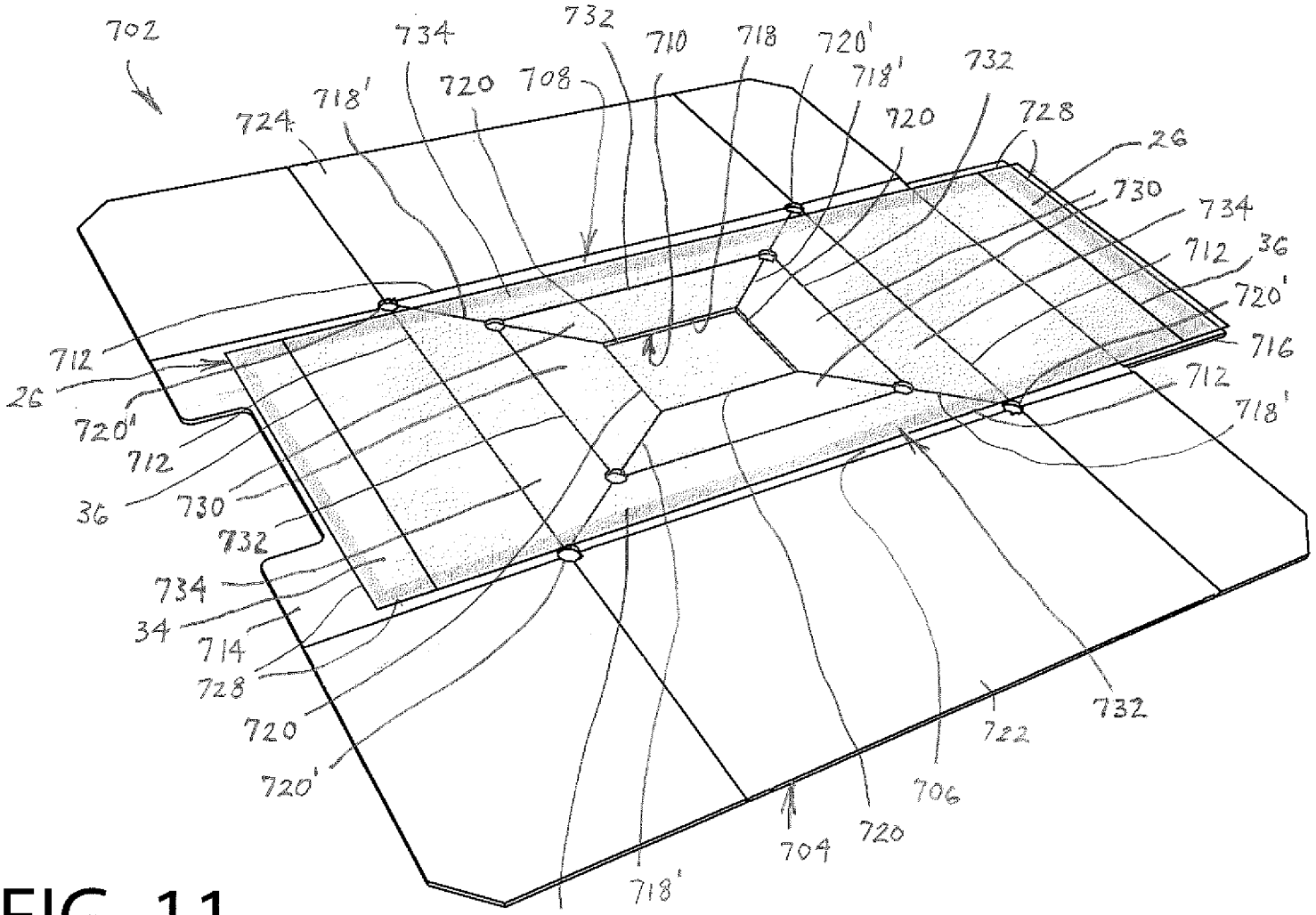
FIG. 11 is an upper perspective view of an eighth example of a packaging structure in a planar position that is of somewhat similar construction to the packaging structure shown in FIG. 10, but includes additional slits or openings that extend in various angular orientations to each other and that define a combination opening and weakened zone lacking substantial rigidity and provide a flexible support panel.
Figure 12:
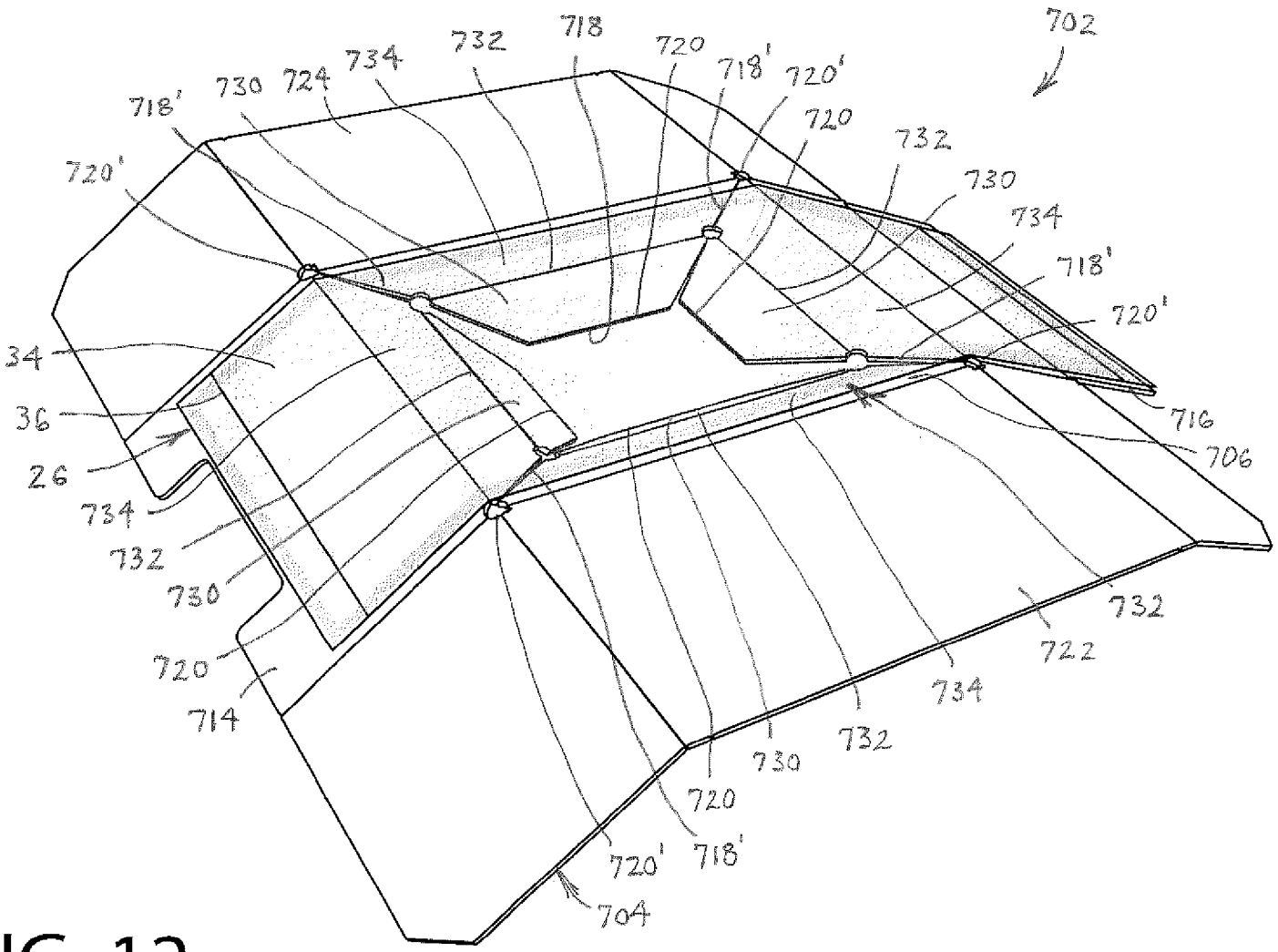
FIG. 12 is an upper perspective view of the eighth example of a packaging structure shown in FIG. 11, but showing the weakened zone lacking substantial rigidity and falling inward upon lifting of the packaging structure.

Turning to FIGS. 11-12, an eighth example packaging structure 702 includes a support frame 704 having at least a platform panel 706 having first and second opposed faces 708, 710, and outer edges 712. The platform panel 706 is pivotally connected to a pair of opposed side panels 714, 716, such as along fold lines or other lines of weakness, which may be formed in a manner as discussed with respect to the above examples. The platform panel 706 also may be pivotally connected to a second pair of opposed side panels 722, 724. As with the prior examples, the support frame 704 has an overall length in a first direction that includes the platform panel 706 and the pair of opposed side panels 714, 716 when the platform panel 706 and side panels 714, 716 are disposed in a planar orientation, such as is shown in FIG. 11. The support frame 704 also may be constructed of various different materials, as discussed above with respect to the first example packaging structure 2.

The packaging structure 702 is illustrated as being constructed in a manner wherein the platform panel 706 includes an opening and a weakened zone within the platform panel. More specifically, the illustrated structure includes at least one enlarged opening 718, preferably centrally located and generally having edges 720. The platform panel 706 further includes slits or other openings or lines of weakness 718' that extend in angular orientations to each other and from respective corners of the opening 718. It will be appreciated that the angled slits 718' could be directly in communication with each other, but in this example, the slits 718' are in communication with and extend from the enlarged opening 718 toward the respective outer corners of the platform panel 706. The slits 718' are shown as being elongated and having parallel side edges, with the ends toward the corners of the platform panel 706 flaring into a larger generally circular-shaped opening 720', to resist tearing. The area of the panel generally between the edges 720 of the opening 718 and the outer ends of the slits 718' defines a weakened zone around the opening 718.

The weakened zone of this example is broadly in the form of two rows of bendable flaps having free end edges defined by adjacent slits 718', with an innermost row of flaps 730 defined by the edges at the slits 718', the edges 720 of the opening 718 and further lines of weakness 732 that are located between the edges 720 of the opening 718 and the outer edges 712 of the platform panel. The lines of weakness 732 and the outer edges 712 of the platform panel define a second or outermost row of flaps 734 that are pivotally connected to the innermost row of flaps 730. The opening 718 and weakened zone formed by the slits 718' and the lines of weakness 732 also cause the platform panel 706 to lack substantial rigidity, and instead to provide a flexible support panel. This is readily apparent when viewing FIG. 12, which shows the flaps 730, 734 angled downward.

In this eighth example, the area of the platform panel 706 that includes the angled slits 718' and the optional opening 718 together provide a flexible support panel 732 that permits some flexible suspension of an article to be placed within the packaging structure 702, in contrast to a substantially rigid panel or backing. The slits 718, 718' may be of varied length and width, and may be intermittent or continuous, as the particular packaging requirements demand, so as to take advantage of the flexibility in the support panel 732.

The construction, dimensions and coupling of the first flexible sheet 26 and second flexible sheet 34 to the support frame 704 of the eighth example are similar to those shown and described for the fifth example shown in FIG. 8. Thus, the first flexible sheet 26 is connected to the pair of opposed pivotable side panels 714, 716 along two respective outer edges 728, and connected to the platform panel 706 along two other respective edges 728, such that the connection of the first flexible sheet 26 also is between the outer edges 728 of the first flexible sheet 26 and the edges 720, 720' of the respective at least one opening, in the form of the slits 718, 718'. As with the prior examples, this permits connection of the first flexible sheet 26 to a single side of the support frame 704 in a very efficient and cost effective manner, such as by use of glue or other materials and methods, as described with respect to the prior examples. As discussed and shown with respect to some of the prior examples, the second flexible sheet 34 is shown as being coupled to the pair of opposed pivotable side panels 714, 716 by use of heat seals 36 to the first flexible sheet 26, which in turn is connected to the side panels 714, 716. It will be appreciated that other methods of connection of the first and second flexible sheets 26, 34 could be utilized, consistent with the discussion of the prior examples, resulting in the second flexible sheet 34 overlying the first flexible sheet 26.

The loading of an article between the first and second flexible sheets 26, 34 may be accomplished, as discussed with respect to the prior examples, by sliding an article therebetween in a region of the second flexible sheet 34 that remains unconnected to the first flexible sheet 26. To hold an article in place against the first flexible sheet 26 that overlies the flexible support panel 732, the pair of opposed side panels 714, 716 are pivoted away from the first face 708 and toward the second face 710 of the platform panel 706 along the edges 712 of the platform panel 706, at fold lines or other lines of weakness. This increases the tension in the second flexible sheet 34. The tension in the second flexible sheet 34 will tend to force the article to press downward against the first flexible sheet 26 at the weakened zone and opening, which will allow some of the tension and stretch to be accommodated by the flexible support panel 732 and the first flexible sheet 26, by permitting an article to press downward and through the original plane of the platform panel 706. This may relieve some of the stress on the second flexible sheet 34, which would otherwise have to bear all of the deformation to accommodate the article. This also will help hold the article from shifting laterally, and the first flexible sheet 26 will prevent the article from contacting the platform panel 706, thereby avoiding potential abrasions, scuffing or other damage to the article.

As with the prior examples, with an article inserted between the first and second flexible sheets 26, 34 and the pair of side panels 714, 716 pivoted away from the first face 708 and toward the second face 710 of the platform panel 706, and the second pair of side panels 722, 724 pivoted toward the first face 708 of the platform panel 706, the packaging structure 702 may be moved to a position that is similar to that shown in FIG. 3, for insertion into an outer container, such as a box, envelope or other suitable container for shipping. The packaging structure 702 will suspend the article in a position where it is spaced from the outer walls of the container and safely secured within the packaging structure between the first and second flexible sheets 26, 34. Additional cushioning may be provided by having the side panels 714, 716 pivoted to a position extending at an angle below the platform panel 706 to provide a spring suspension, similar to the position shown for the example in FIG. 7.

Figure 13:
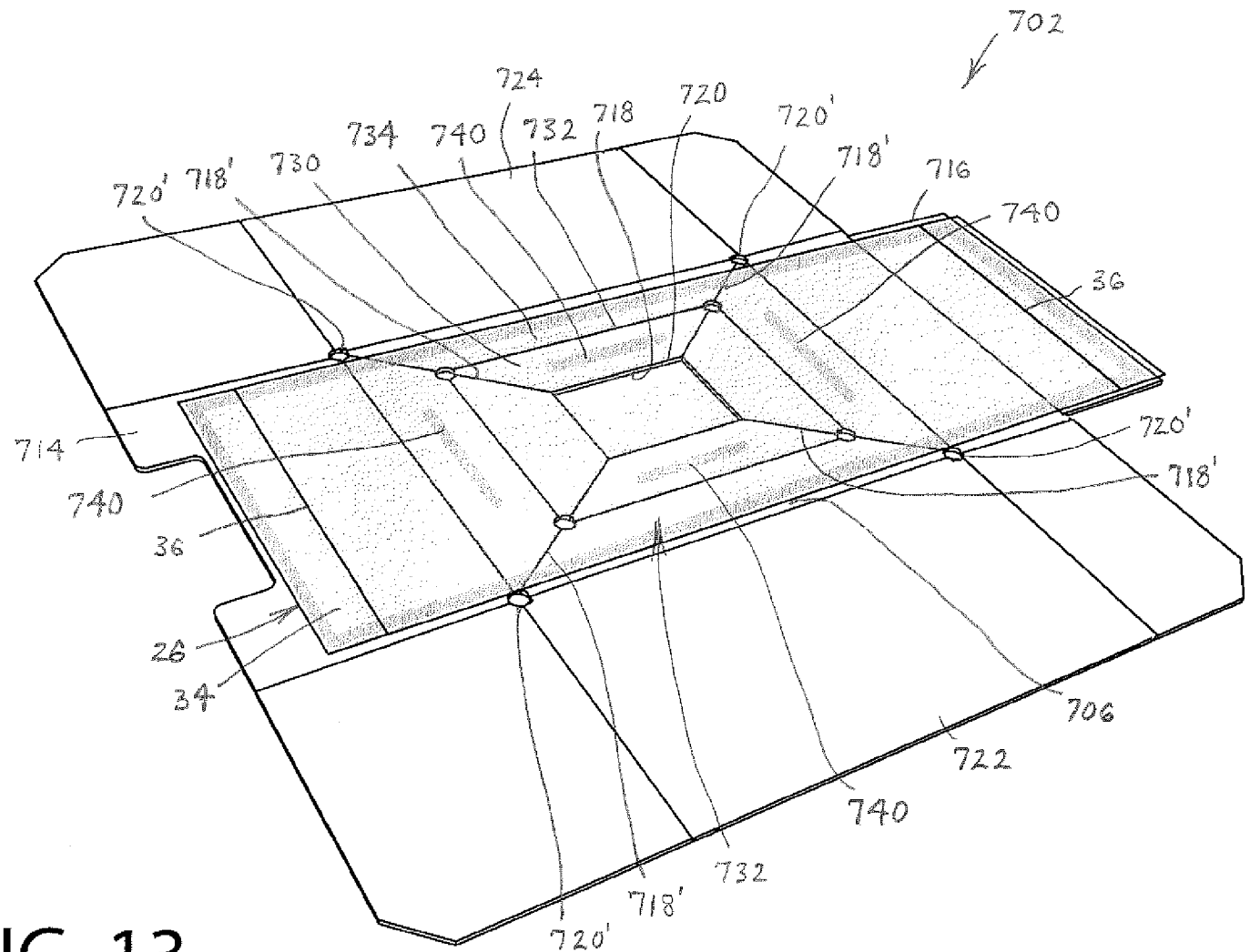
FIG. 13 is an upper perspective view of a modified version of the eighth example of a packaging structure that is shown in FIGS. 10-11, in a planar position including additional points of connection between the first flexible sheet and the packaging structure having slits or openings that extend in various angular orientations to each other and that define a combination opening and weakened zone lacking substantial rigidity and provide a flexible support panel.

FIG. 13 illustrates an optional modification to the packaging structure shown in FIGS. 11-12. In FIG. 13, a plurality of flaps from within the innermost and outermost rows of flaps 730, 734 are at least partially connected or tacked to the first flexible sheet 26, such as by use of adhesive, in the form of glue strips 740, or other suitable means of mechanical connection. The additional areas of connection between the first flexible sheet 26 and the flexible support panel 732 allow the non-rigid platform panel 706 to interact with and lend some support to the first flexible sheet 26, which can be of assistance when loading an article between the flexible sheets 26, 34 and then initially lifting the packaging structure 702 to be able to pivot the side panels 714, 716 to a position below the platform panel 706, while still providing a flexible support panel 732.

Although described in terms of preferred and alternate embodiments, the present subject matter may be employed in other configurations and with other materials without departing from the principles of the subject matter as described above and as set forth in the following claims.

From the description of the above examples, it will be further understood that this disclosure provides suspension packaging that may incorporate many advantages over the prior art. Reduced scrap may be achieved by using simplified outer shapes for a support frame and first and second flexible sheets. The connection of the first and second flexible sheets along a first face of the support frame also may permit simplified manufacturing, use of shorter lengths of flexible sheet materials and potentially less flexible sheet material, because the first and second flexible sheets need not extend beyond the edges of the support frame. This, in turn, avoids having a flexible sheet fold over or present a pocket at the bottom edge of a support frame when inserted into an outer container, where it could otherwise be damaged by rubbing against the bottom of such a container during shipment. Efficient material usage is achieved while providing the desirable condition of having a flexible support panel or a flexible sheet between an article and a support frame, with a flexible sheet both above and below the article.

The potential reductions in material usage also may provide cost and weight savings that are important in the initial shipment of packaging structures to a user, as well as in the shipment of packaging structures to a final destination when housing the articles to be shipped. The connection of the first and second flexible sheets along a first face of the support frame also facilitates easy positioning of the opposed side panels in pivoted positions for tensioning the second flexible sheet. The unique structures permit clean and easy assembly and disassembly of the first and second flexible sheets to the support frame, without the use of mechanical fasteners. This also promotes efficient recycling where the reduction in material usage can be of further benefit, as well.

Thus, the foregoing detailed description and accompanying drawings have been provided by way of explanation and illustration, and are not intended to limit the scope of the appended claims. Many variations in the presently preferred examples illustrated herein will be apparent to one of ordinary skill in the art, and remain within the scope of the appended claims and their equivalents.

The invention claimed is:

1. A packaging structure adapted for insertion into an outer container, comprising:

a one-piece support frame including at least a platform panel defined by a first pair of opposed outer edges and a second pair of opposed outer edges, and the platform panel having a first face opposed to a second face and at least one opening, and the one-piece support frame further including at least a pair of opposed side panels pivotally connected to the platform panel along the respective first pair of opposed outer edges;

a first flexible sheet overlying at least a portion of the first face of the platform panel and extending over and beyond the at least one opening but not beyond the second pair of opposed outer edges, with the first flexible sheet being fixedly connected directly to the support frame between respective edges of the first flexible sheet and edges of the at least one opening, wherein a flexible support panel is provided overlying the at least one opening; and a second flexible sheet overlying at least a portion of the first flexible sheet and being fixedly connected to the pair of opposed side panels, wherein the second flexible sheet is tensioned when the side panels are pivoted away from the first face of the platform panel.

2. The packaging structure of claim 1 further comprising an access opening for inserting an article between the first and second flexible sheets.

3. The packaging structure of claim 2 wherein the access opening is defined by a region where the second flexible sheet is not connected to the first flexible sheet.

4. The packaging structure of claim 1 wherein the support frame includes a second pair of opposed side panels pivotally connected to the platform panel along the second pair of opposed outer edges and that extend from the platform panel in a direction perpendicular to the pair of opposed side panels pivotally connected to the platform panel along the first pair of opposed outer edges.

5. The packaging structure of claim 1 wherein the first flexible sheet is comprised of a plastic film material.

6. The packaging structure of claim 1 wherein the second flexible sheet is comprised of a plastic film material.

7. The packaging structure of claim 1 wherein the first and second flexible sheets are comprised of film materials that are connected to each other by heat seal or adhesive.

8. The packaging structure of claim 1 wherein the second flexible sheet is coupled to the pair of opposed side panels by adhesive.

9. The packaging structure of claim 1 wherein the first flexible sheet is connected to the platform panel between the edges of the at least one opening and the first and second pairs of outer edges of the platform panel.

10. The packaging structure of claim 1 wherein the first flexible sheet is connected to the pair of opposed side panels that are connected to the platform panel along the first pair of opposed outer edges and is connected to the platform panel between edges of the at least one opening and a second pair of opposed side panels that are connected to the platform panel along the second pair of opposed outer edges.

11. The packaging structure of claim 1 wherein the pair of opposed side panels are pivotable to a position to provide spring suspension of the platform panel.

12. The packaging structure of claim 1 wherein the at least one opening further comprises lateral slits, spaced apart longitudinally.

13. The packaging structure of claim 1 wherein the at least one opening further comprises longitudinal slits, spaced apart laterally.

14. The packaging structure of claim 1 wherein the at least one opening is located in a weakened zone further comprising slits that extend in angular orientations to each other.

15. The packaging structure of claim 1 wherein the at least one opening is located in a weakened zone further comprising slits that extend in angular orientations to each other and define flaps in the platform panel, and wherein some of the flaps are connected to the first flexible sheet.

16. A method of making a one-piece packaging structure adapted for insertion into an outer container, comprising the steps of:

providing a support frame having at least a platform panel defined by a first pair of opposed outer edges and a second pair of opposed outer edges, and the platform panel having a first face opposed to a second face and at least one opening, and the one-piece support frame further including at least a pair of opposed side panels pivotally connected to the platform panel along the respective first pair of opposed outer edges;

providing a first flexible sheet overlying at least a portion of the first face of the platform panel and extending over and beyond the at least one opening but not beyond the second pair of opposed outer edges;

fixedly connecting the first flexible sheet directly to the support frame between respective edges of the first flexible sheet and edges of the at least one opening, wherein a flexible support panel is formed overlying the at least one opening;

providing a second flexible sheet overlying at least a portion of the first flexible sheet; and fixedly connecting the second flexible sheet to the pair of opposed side panels, wherein the second flexible sheet is tensioned when the pair of opposed side panels are pivoted away from the first face of the platform panel.

17. The method of making a packaging structure of claim 16 wherein the second flexible sheet is connected to the first flexible sheet by heat seal or adhesive.

18. The method of making a packaging structure of claim 17 wherein the second flexible sheet is connected to the first flexible sheet prior to the first flexible sheet being connected to the support frame.

19. The method of making a packaging structure of claim 16 wherein the second flexible sheet is connected to the pair of opposed side panels.

20. The method of making a packaging structure of claim 19 wherein the first flexible sheet is connected to the support frame prior to the second flexible sheet being connected to the pair of opposed side panels.

21. The method of making a packaging structure of claim 16 wherein the first flexible sheet is connected to the platform panel between the edges of the at least one opening and the first and second pairs of outer edges of the platform panel.

22. The method of making a packaging structure of claim 16 wherein the at least one opening is located in a weakened zone further comprising slits that extend in angular orientations to each other.

* * * * *